US010553133B2

(12) United States Patent
Havermann

(10) Patent No.: US 10,553,133 B2
(45) Date of Patent: Feb. 4, 2020

(54) APPARATUS AND METHOD FOR MONITORING THE MANIPULATION OF A TRANSPORTABLE OBJECT

(71) Applicant: HARTING IT Software Development GmbH & Co. KG, Espelkamp (DE)

(72) Inventor: Gert Havermann, Wallenhorst (DE)

(73) Assignee: HARTING IT SOFTWARE DEVELOPMENT GMBH & CO,. KG (DE)

( * ) Notice: Subject to any disclaimer, the term of this patent is extended or adjusted under 35 U.S.C. 154(b) by 48 days.

(21) Appl. No.: 15/779,308

(22) PCT Filed: Dec. 2, 2016

(86) PCT No.: PCT/DE2016/100565

§ 371 (c)(1),
(2) Date: May 25, 2018

(87) PCT Pub. No.: WO2017/097288

PCT Pub. Date: Jun. 15, 2017

(65) Prior Publication Data

US 2018/0322814 A1 Nov. 8, 2018

(30) Foreign Application Priority Data

Dec. 8, 2015 (DE) ..... 10 2015 121 375

(51) Int. Cl.
*G09F 3/03* (2006.01)

(52) U.S. Cl.
CPC ..... *G09F 3/0335* (2013.01); *G09F 3/0329* (2013.01); *G09F 3/0347* (2013.01)

(58) Field of Classification Search
None
See application file for complete search history.

(56) References Cited

U.S. PATENT DOCUMENTS 4,807,284 A * 2/1989 Kleijne ..... G06F 21/86 380/52
4,884,507 A * 12/1989 Levy ..... A45C 13/24 102/293

(Continued)

FOREIGN PATENT DOCUMENTS

DE 19520226 12/1996 ..... G01R 11/24
DE 19855209 6/2000 ..... G06F 21/87

(Continued)

OTHER PUBLICATIONS

German Office Action (w/machine translation) issued in application No. 10 2015 121 375.3, dated Aug. 7, 2018 (10 pgs).

(Continued)

*Primary Examiner* — Curtis J King
(74) *Attorney, Agent, or Firm* — Hayes Soloway P.C.

(57) ABSTRACT

The problem addressed by the disclosure is that of specifying an inexpensive, easily operable and largely automatable and reusable apparatus and a corresponding method for monitoring the manipulation of a transportable object. For example, the disclosure can be used to monitor the actuation of an opening flap of a transportation box without a current. For this purpose, the apparatus has the following: a magnetic data memory for storing an item of control information; a permanent magnet for destroying this control information; a mechanism for destroying the control information in the magnetic data memory by means of the permanent magnet; a data interface; a data connection between the magnetic data memory and the data interface for interchanging data between the magnetic memory and the data interface in a bidirectional manner.

26 Claims, 19 Drawing Sheets

(56) References Cited

U.S. PATENT DOCUMENTS 5,097,253 A * 3/1992 Eschbach ..... G06K 19/07749 340/545.1
5,148,150 A * 9/1992 White ..... A45C 13/24 200/61.52
5,768,389 A * 6/1998 Ishii ..... H04L 9/0897 380/277
6,054,930 A 4/2000 Guillon ..... 340/637
6,133,842 A * 10/2000 Gariepy ..... G08B 13/1436 340/545.1
6,688,241 B1 * 2/2004 Reilly ..... E05G 1/00 109/29
6,784,796 B2 * 8/2004 Johnston ..... G08B 13/06 324/207.11
7,159,114 B1 * 1/2007 Zajkowski ..... G06Q 20/3552 713/171
7,194,759 B1 * 3/2007 Chess ..... H04L 9/321 705/1.1
8,261,367 B2 * 9/2012 Lenssen ..... G06F 21/79 257/659
8,909,942 B1 12/2014 Obukhov et al. ... G06F 12/1408
2003/0056099 A1 * 3/2003 Asanoma ..... G06Q 20/341 713/172
2004/0215532 A1 * 10/2004 Boman ..... G06Q 10/06 705/28
2005/0046567 A1 * 3/2005 Mortenson ..... G06Q 10/047 340/539.13
2005/0225432 A1 * 10/2005 Lindskog ..... E05G 1/005 340/5.73
2005/0253708 A1 * 11/2005 Bohman ..... E05B 39/04 340/539.22
2006/0081497 A1 * 4/2006 Knudsen ..... G06F 21/71 206/701
2006/0108668 A1 * 5/2006 Knudsen ..... G11C 8/20 257/659
2006/0146597 A1 7/2006 Lenssen et al. ..... 365/158
2006/0152173 A1 * 7/2006 Erez ..... G06F 21/79 315/307
2007/0001855 A1 * 1/2007 Bohman ..... B65D 90/00 340/572.1
2009/0070434 A1 * 3/2009 Himmelstein ..... H04L 51/38 709/217
2009/0259793 A1 * 10/2009 Muraki ..... G06F 21/6245 711/100
2009/0327756 A1 * 12/2009 Pekowsky ..... G06F 21/10 713/192
2010/0283580 A1 * 11/2010 Sheng ..... B65D 90/22 340/5.31
2010/0313056 A1 * 12/2010 Margolis ..... G06F 1/263 713/500
2011/0004938 A1 * 1/2011 Dalzell ..... F42D 3/00 726/26
2013/0111600 A1 * 5/2013 Guenther ..... G06F 21/72 726/26
2013/0322984 A1 12/2013 Bauchot et al. ..... F16B 39/02
2015/0226769 A1 8/2015 Boudreau, Jr. et al. ..... G01R 11/24
2015/0259968 A1 * 9/2015 Beckman ..... E05G 1/005 109/38
2015/0301964 A1 10/2015 Brinicombe et al. ... G06F 13/28
2016/0034899 A1 * 2/2016 Myers ..... H04B 5/0081 705/44
2016/0267284 A1 * 9/2016 Willis ..... H04L 63/08
2017/0311117 A1 * 10/2017 Rivas ..... G06F 21/32

FOREIGN PATENT DOCUMENTS

DE 102008004292 7/2009 ..... G08B 13/08
EP 0949511 10/1999 ..... G01F 15/00
EP 1878861 1/2008 ..... E05B 73/00

OTHER PUBLICATIONS

German Office Action (w/machine translation) issued in application No. 10 2015 121 375.3, dated Jul. 15, 2016 (13 pgs).
International Preliminary Report on Patentability (w/translation) issued in application No. PCT/DE2016/100565, dated Jun. 12, 2018 (14 pgs).
International Search Report and Written Opinion (w/translation) issued in application No. PCT/DE2016/100565, dated Mar. 27, 2017 (20 pgs).

* cited by examiner

APPARATUS AND METHOD FOR MONITORING THE MANIPULATION OF A TRANSPORTABLE OBJECT

BACKGROUND OF THE INVENTION

The invention is directed in a first aspect to a device for monitoring the manipulation of a transportable object.

The invention is directed in a second aspect to a method for monitoring the manipulation of a transportable object.

Furthermore, the invention is directed in a third aspect to an integrated component for carrying out the method.

Such a device and method are required to monitor whether a manipulation was performed on specific objects, for example, during a transportation, and in particular whether no manipulation was performed thereon. It can be established in this manner, for example, whether a container having sensitive contents was opened during its transportation or not.

DISCUSSION OF THE PRIOR ART

Electronic seals are known in the prior art. Furthermore, electronic seals for objects to be transported and in particular for transportation containers are known. The areas of application are manifold; such transportation containers can be sealed, for example, for the transportation of money, jewelry, valuable papers, documents usable in court, and sensitive biochemical substances, for example, material for DNA analysis and much more, to prove the possibility of a possibly unauthorized access—or in particular in the case of an intact seal, to prove no such access has taken place in the meantime.

Document DE 10 2008 004 292 A1 discloses an electronic sealing device, consisting of an analysis unit and a recognition cable connected to this analysis unit. The recognition cable comprises means which, in the sealed state of the sealing device upon request of the analysis unit, transmit a digital signal uniquely assignable to this recognition cable to the analysis unit. The recognition cable is designed such that upon opening of the sealing device, the connection between the analysis unit and the means for generating the uniquely assignable digital signal is necessarily interrupted.

Furthermore, a method for the electronic sealing of containers of greatly varying types is known from document DE 198 55 209 A1. Upon startup, individual features, which characterize the closing state and are not measurable externally, of the housing, a part thereof, or functional elements operationally connected to the housing are acquired and stored. The acquisition of these identification features is repeated during operation. The values measured in this case are compared to the stored values. Any significant deviation of the present values from the stored values triggers an alarm signal.

The prior art has the disadvantage that the known methods often cause irreversible changes and/or are comparatively complex in the design and in the application thereof and/or have to be individually adapted to specific applications with great effort. Furthermore, a significant disadvantage of these systems is that the monitoring thereof requires electrical energy, which in particular makes monitoring during transportation, for example, by a delivery service, nearly impossible. In particular, dischargeable electrical energy stores such as batteries, rechargeable batteries, capacitors, etc. have also proven to be unsuitable for this purpose, since they are unreliable and manipulable, for example, by severing the feed line and/or by discharge. Therefore, a prefinished solution is lacking, which is usable in manifold ways, can in particular be produced cost-effectively in high piece counts, is flexibly usable, simultaneously offers a comparatively high level of security in particular for especially sensitive applications, and is in particular suitable for monitoring the transportation of objects at risk of manipulation, for example, of transportation boxes.

OBJECT OF THE INVENTION

The object of the invention is to overcome the above-mentioned disadvantages and at the same time to specify a cost-effective, easily operable, and substantially automatable and reusable device and a corresponding method for monitoring the manipulation of a transportable object.

SUMMARY OF THE INVENTION

The device for monitoring the manipulation of the transportable object comprises the following base elements:

- a magnetic data memory for storing an item of checking information;
- a permanent magnet for destroying this item of checking information;
- a mechanism for carrying out the destruction of the item of checking information of the data memory by the permanent magnet;
- a data interface;
- a data connection between the magnetic data memory and the data interface for the bidirectional data exchange between the magnetic data memory and the data interface.

The method for monitoring the manipulation of the transportable object comprises the following steps:

a) ensuring a geometric distance of the magnetic data memory from a permanent magnet which is sufficiently large for data storage in a magnetic data memory;
b) transmitting and writing an item of checking information from a monitoring unit into the magnetic data memory;
c) transmitting and writing the checking information in a second data memory;
d) transporting the object to a predetermined intended location;
e) reading out, transmitting, and comparing the content of the magnetic data memory to the content of the second data memory.

The integrated component for carrying out the method comprises the following:

- the magnetic data memory (10) for storing the item of checking information (101);
- the second data memory (17) for retaining the item of checking information (101);
- a data interface (13) for transmitting the item of checking information (101).

The data interface can be in particular an RFID chip and/or an RFID transponder or the data interface can have at least one RFID chip and/or one RFID transponder as a component. An RFID transponder includes in this case and hereafter the RFID chip and an antenna, which is, for example, electrically conductively connected and/or inductively coupled thereto. The magnetic data memory can be embodied in MRAM ("magnetoresistive random access memory") technology. The second data memory can be an EPROM, an EEPROM, a flash memory, an F-RAM, or an S-RAM. The integrated component can use a microprocessor of the data interface, in particular of the RFID chip, to control the data transmission, or can have an additional microprocessor for this purpose. The integrated component can be embodied in particular as an integrated circuit ("IC"), and therefore it can be manufactured particularly cost-effectively.

The device is used for the purpose of being able to recognize a manipulation with particularly high reliability and simultaneously with only little expenditure. The device can advantageously be reused after monitoring, in particular also after completed and established manipulation without, for example, mechanical changes/repairs, inter alia, because all possibly performed changes relate to the content of the data memory, which can be written nearly arbitrarily often.

In particular, the invention ensures cost-effective electronic sealing with high operating convenience and a particularly high level of automation ability and can thus also be used in the shipping of products, at least in the shipping of particularly sensitive and/or valuable goods, for example, also in the online mail-order business, flexibly and in high piece counts.

A particularly good automation ability of the monitoring procedure is provided in this case in the form of automatic sealing, on the one hand, on the output side, i.e., packages which leave a supplier via a conveyor belt, for example, can receive such electronic sealing, preferably wirelessly, for example, via an RFID reader. On the other hand, automated monitoring of the electronic seal is also possible on the intake side at the receiver, preferably via a wireless data transmission, also in particular via an RFID reader. For this purpose, it is advantageous, of course, if the device, in particular as a component of its data interface, has an RFID transponder or at least one RFID chip, in particular having an associated antenna.

It is particularly advantageous if the base elements of the device are arranged in or on an associated housing, because this enables corresponding mass production and simultaneously individually adapted installation even in very different transportable objects. For example, such a device can be integrated in unchanged structural form both in the luggage compartment of a passenger automobile and also in a package to be shipped or in any other transportable object to be monitored, for example, a flying drone.

Furthermore, such a device can be embodied, for example, in the form of a padlock and can thus also be attached to a corresponding closure of an object to be monitored, for example, a transportation box. This has the advantage that commercially available transportation boxes, which are already on the market, having closures which are provided for the use of padlocks, can be used in combination with such a padlock-type device.

In one preferred embodiment, the magnetic data memory is embodied in MRAM ("magnetoresistive random access memory") technology. For example, the magnetic data memory can be embodied as a separate MRAM component. In this case, however, it can also be an integral part of a comprehensive component embodied, for example, in MRAM technology, for example, an integrated circuit which additionally has, for example, a processor and/or a further memory element. In particular, such a comprehensive component can also include the data interface which, as already mentioned above, can include the RFID chip and preferably also an associated antenna. Such an integrated construction enables particularly cost-effective mass production and a small structural size and therefore also opens up a variety of new possible applications because of its cost-effectiveness.

Furthermore, it is particularly advantageous if a corresponding system for manipulation monitoring comprises both said device and also the transportable object to be monitored and in particular a separate monitoring unit. This monitoring unit can advantageously be embodied as geometrically separate or at least separable from the device and in particular also from the object to be monitored, i.e., it can have, for example, a separate monitoring unit housing. This monitoring unit is therefore preferably not arranged in or on the object to be monitored, but rather separately therefrom.

The item of checking information can be written on the magnetic data memory via the data interface of the device, in particular by the monitoring unit. This corresponds to electronic sealing. If a manipulation takes place, the content of the magnetic data memory is thus destroyed. This corresponds to the destruction of the seal. The content of this magnetic data memory can thus, after a time span to be monitored, in particular after the transportation of the object to be monitored, provide information about a possibly occurring manipulation, which corresponds to checking the seal.

If it is established in this case that the content of the magnetic data memory no longer corresponds to the original item of checking information, this thus means that the mechanism has been actuated, and the electronic seal is thus destroyed. This furthermore means that a manipulation has taken place or at least the possibility exists that a manipulation has taken place. It is particularly advantageous in this case if the item of checking information is in particular unique in the world or is at least so distinctive that a random correspondence with a random number generated, for example, by the magnetic destruction thereof can be considered to be sufficiently improbable for the respective application.

To carry out this check, the item of checking information could, of course, be retained in the monitoring unit and, for example, after completed transportation of the object to be monitored from a first location to a second location, could be read out again by the same monitoring unit. However, this has the disadvantage that the monitoring unit also has to be transported to this second location. For example, for this purpose the monitoring unit can be a transportable, so-called "handheld" unit, which can be entirely reasonable for some applications, for example, if a customer in the case of a move wishes to check his moving boxes after completed transportation by a removals company for manipulation and for this purpose carries such a handheld unit, for example, a smartphone having integrated or connected RFID reader. Nonetheless, such a method is not particularly reasonable for most applications, and in particular for most industrial applications.

In a further preferred embodiment, a further monitoring unit is therefore also provided, which can be embodied as mobile, for example, in the form of such a "handheld" unit. Such a further monitoring unit can be carried, for example, by a package delivery service, to demonstrate and electronically establish on location to the customer the non-manipulated nature of the shipped product.

However, the further monitoring unit can also be embodied as stationary and can be located permanently at the second location. In this manner, for example, a product transportation between two industrial companies can be monitored, in particular also in automated fashion. The two monitoring units can be connected to one another for this purpose, for example, via a data line, a mobile wireless connection, via the Internet, or any other data connection, in particular for encrypted transmission of the item of checking information. However, in this case the disadvantage exists under certain circumstances that the required data security can no longer always be guaranteed and experience has shown that said data connections do not always function reliably.

In a further particularly preferred embodiment, the item of checking information is therefore stored in the device itself in a second data memory and retained to carry out this check, wherein the second data memory is preferably arranged in the housing of the device. For this purpose, it is particularly advantageous if the content of this second data memory is resistant to the magnetic field of the permanent magnet. This is because the content of the magnetic data memory is separately destructible by the permanent magnet, but without the content of the second data memory being destroyed at the same time. In other words, it is particularly advantageous if the content of the magnetic data memory is separately destructible by the permanent magnet, while the content of the second data memory can simultaneously be preserved unchanged. This can already be ensured, for example, in that the type of the second data memory differs from the type of the magnetic data memory. The second data memory can be, for example, an EPROM, an EEPROM, a flash memory, an F-RAM, or an S-RAM. This is particularly advantageous because then the magnetic data memory and the second data memory can even be arranged adjacent on a single chip or at least inside the comprehensive component, because the magnetic field of the permanent magnet does not destroy the information of the second data memory even in the event of corresponding approach to its geometrical position.

For this purpose, it is advantageous if the data transmission for transmitting the item of checking information from the monitoring unit to the magnetic data memory and possibly also to the second data memory takes place in each case in encrypted and/or password-protected form.

Vice versa, it is also advantageous if the read procedure, i.e., the data transmission to transmit the content of the magnetic data memory and possibly also the content of the second data memory to the monitoring unit and/or possibly to the further monitoring unit takes place in each case in encrypted and/or password-protected form.

Furthermore, it is particularly advantageous to avoid possible error sources if the transmission of the items of checking information takes place exclusively between the respective monitoring unit and the magnetic data memory or between the monitoring unit and the second data memory, respectively, but not between the magnetic data memory and the second data memory. For this purpose, it is in particular especially advantageous if the second data memory possibly has a bidirectional data exchange via a further separate data connection with the data interface.

In one advantageous embodiment, said mechanism of the device can mechanically interact with the permanent magnet. The mechanism can thus be capable of reducing the geometric distance between the permanent magnet and the magnetic data memory, to thus destroy the item of checking information stored in the magnetic data memory, for example, upon opening of the container. This is particularly advantageous because thus a simple mechanical procedure for the purpose of monitoring the manipulation detects immediately without the requirement of an electrical power supply and this information can be stored. The monitoring for manipulation thus functions, in other words, without power, which represents a particularly significant advantage with respect to the reliability of the monitoring, in particular during the transportation of the object to be monitored.

If it is established after the transportation, or in a possible alternative application, for example, also only after passage of a time span to be monitored, that the content of the magnetic data memory corresponds to the original checking word, which is retained in particular in the second data memory, this thus means that the mechanism was not actuated, the seal is thus preserved intact, and therefore no manipulation has taken place. If the object is a container, it can thus be concluded from such an intact seal that no access has taken place to the content of the container. A customer can thus establish, for example, that he receives the shipped product unchanged and without external access or a research laboratory can establish that it has received the originally shipped biochemical sample at least without manipulative manual engagement. For additional monitoring of further influences which possibly act on the content, which do not make the opening of the container necessary, i.e., for example, shocks or exceeding or falling below specific air pressure, humidity, and/or temperature ranges, radioactive radiation, or further comparable environmental influences, of course, the device can be supplemented by other corresponding, in particular powerless monitoring methods, i.e., combined therewith.

Furthermore, the mechanism can comprise an actuator, on which the permanent magnet is arranged. The mechanical coupling of the permanent magnet to a manipulation-significant component of the transportable object to be monitored can thus be implemented in a particularly advantageous manner. For example, by actuation of the actuator, in particular by pressing or pulling the actuator respectively into or out of the housing of the device, or also by rotating the actuator or possibly also by a combined translation/rotation movement of the actuator, the permanent magnet can be moved toward the magnetic data memory or moved away therefrom.

In one preferred embodiment, the mechanism can have further parts in addition to the actuator. The magnet can then be arranged both on the actuator and also alternatively thereto on one of these further parts. These parts can mechanically interact. For example, the actuator can be held so it is movable, for example, displaceable and/or rotatable on the device, in particular on a housing of the device. To be held so it is displaceable on the housing, the actuator can have a rail, for example, which engages in a groove of the housing. The further parts of the mechanism are also moved automatically by a movement of the actuator, to enable unlocking and simultaneously move the permanent magnet into the vicinity of the magnetic data memory.

These said further parts can be, for example, a locking element and a bracket, and therefore the device can be designed like a padlock.

The locking element can then be displaced alternately into a position locking or unlocking the bracket by a movement, for example, a displacement of the actuator of such a padlock-type device. In the locking position, the bracket is fixed. The magnetic data memory is writable in this state.

This padlock-type device can also be unlocked by an actuation of the actuator. In the unlocked position, the bracket is movable, and in this state the magnetic data memory is overwritten by the magnetic field of the permanent magnet with a random number, whereby its information can be referred to as "erased". For this purpose, the permanent magnet can be arranged on the actuator, for example, and can be guided by the actuation of the actuator into the vicinity of the magnetic data memory.

It is particularly advantageous if the actuator has a spring element. The spring force thereof can then counteract the actuation of the actuator, i.e., apply a restoring force against a deflection from its starting position. If the actuator is released again after the deflection, it can thus be returned by this spring automatically into its starting position. In particular, the permanent magnet can be moved to the magnetic data memory by just this return to the starting position and destroy the information thereof, and therefore strictly speaking in this case not the actuation of the actuator but rather a return into its starting position destroys the item of checking information in the magnetic data memory and therefore the electronic seal. This contributes in a particularly advantageous manner to the universal usability of the device according to the invention, because thus with only minor mechanical adaptation of the device to the respective object and usually already merely by fastening and suitable alignment of the device in, for example, a transportation container, the actuator can interact with a manipulation-significant part of the container, for example, a closure, a cover, a door, a flap, a lock, or any further means for opening of the container to be monitored for manipulation. Manipulation-significant in this context means that a manipulation is automatically accompanied by a change on this part. In other words, no manipulation is possible on the object to be monitored without performing a corresponding change on such a manipulation-significant part. A change can in this case be, for example, the opening of the flap or the removal of the cover.

For this purpose, it is thus particularly advantageous if the object to be monitored has such a manipulation-significant part, because a manipulation is thus automatically accompanied by a corresponding change relating to this part and can be detected by the device. Furthermore, it is particularly advantageous in this case if said mechanism interacts with the manipulation-significant part, for example, via a simple mechanical coupling, because a manipulation then automatically causes, as described above, the destruction of an item of information saved in the magnetic data memory, in particular the item of checking information, i.e., a destruction of the seal.

If the object to be monitored is a container and the manipulation-significant part is a closure, a cover, a door, a flap, a lock, or any further means for opening the container to be monitored for manipulation, this is particularly advantageous, because content arranged in this container can thus be secured against manipulation. The manipulation-significant part can in particular be mechanically coupled to the actuator for this purpose such that the container may not be opened without the mechanism being actuated. A particularly flexible use of a device, which is produced in particular in cost-effective mass production, is thus possible, which represents a special advantage. The actuator can execute rotation and/or translation movements in this case, as already mentioned. It can thus be a circular disk, a circular segment, a lever, a pin, or also a mixed form in this case, which is advantageous for the flexible usability. Finally, the actuator can move the permanent magnet into the vicinity of the magnetic data memory or away therefrom by the corresponding rotation and/or translation movement.

In one preferred embodiment, the device, in particular the mechanism thereof, can also have a further manipulation-significant part. For example, in this case this can be the bracket and/or the actuator of the padlock-type device, since the bracket cannot be opened nor can the actuator be actuated without the magnetic memory being overwritten, i.e., the item of checking information stored therein being erased.

As mentioned, it is furthermore particularly advantageous if the device comprises, in addition to said base elements, the second data memory for separately storing the item of checking information, because the item of checking information can thus be maintained in the device itself, to compare it to the content of the magnetic data memory at a second location if necessary. At least the second data memory can be arranged in or on the object to be monitored for this purpose. The second data memory is preferably arranged in or on the housing of the device. Therefore, a further data transfer of the particularly sensitive items of checking information between the two locations, i.e., for example, between the monitoring unit and the further monitoring unit, is not necessary, but rather the object to be monitored transports these data in the second data memory, in particular as a component of the device itself, automatically to its respective intended location.

For this purpose, of course, it is advantageous if the respective monitoring unit has means for reading and comparing the content of the magnetic data memory and possibly the second data memory. These means can consist, for example, of a processor having an integrated and/or external program memory. The processor can thus execute a corresponding program stored in its program memory, and in this case can load the contents of the magnetic memory and the second memory, for example, compare them to one another by means of a comparison operator, and process further program parts as a function of the correspondence thereof and thus cause appropriate actions, for example, an alarm or a release.

For this purpose, the respective monitoring unit can have, for example, means for outputting an alarm display and/or an alarm message and/or an alarm signal, which are used for the purpose of indicating a deviation of the content of the magnetic data memory from the content of the second data memory. These means can be a connected computer monitor, a data interface, for example, to a computer or a network, a lamp, an acoustic signal generator, and also a possible output unit for generating an SMS message, and also any other communication pathway.

In one preferred embodiment, the device has means for wireless data transmission. These means are provided in particular for the data traffic between the monitoring unit and the magnetic data memory and possibly also between the monitoring unit and the second data memory. These means for wireless data transmission are thus used for writing and reading data, in particular the checking data, onto or from, respectively, the magnetic data memory and possibly also for reading and writing data onto or from, respectively, the second data memory by way of the respective monitoring unit.

In particular, said means for wireless data transmission can comprise an RFID reader, which is a component of the respective monitoring unit, and can furthermore comprise an RFID transponder or at least one RFID chip and an associated antenna, which are arranged in or on the object to be monitored and in particular are part of the device and, for example, are associated with its data interface. A wireless connection is thus possible between the object to be monitored, i.e., the corresponding components of the device arranged thereon, on the one hand, and the monitoring unit, on the other hand. This is particularly advantageous because it ensures a high level of operating comfort and also good automation capability of the monitoring, for example, in the case of the abovementioned automated transportation of industrial goods from a supplier to its customers.

The method according to the invention is also used to be able to recognize a manipulation with a particularly high level of reliability, without, for example, repairs being necessary, and the participating components being able to be reused without complex actions, because all performed changes are fundamentally reversible and in particular relate to the content of data memories, which can be written nearly arbitrarily often. For example, upon the use of an EEPROM, one can expect approximately 10 000 storage procedures, in the case of S-RAM, 100 000 storage procedures, and upon the use of M-RAM, even several million storage procedures.

The abovementioned first method step a.), namely the "ensuring of a geometrical distance of the magnetic data memory from a permanent magnet sufficiently large for data storage in a magnetic data memory," can possibly be produced by in particular manual or also by automatic actuation of the manipulation-significant part of an object to be monitored, wherein the mechanism preferably mechanically coupled thereto is capable of moving the permanent magnet away from the magnetic data memory and, for example, by way of an actuation oriented in the opposite direction, can also be capable of guiding the permanent magnet toward the magnetic data memory. Whether the geometric distance necessary for the data storage is already provided in a predefined position can be recognizable, for example, visually or possibly also metrologically, by way of the state of the mechanism, in particular by the position of the actuator and in particular a manipulation-significant part mechanically coupled thereto of the object to be monitored. Alternatively or additionally, as already mentioned, the position of the possibly provided further manipulation-relevant part, for example, the bracket or the actuator of the padlock-type device, can also provide information about the ability to write the magnetic memory. A writing and reading procedure carried out as a test using said suitable structural form can also provide information as to whether the magnetic data memory is sealable in the present position of the mechanism.

Such a recognition of the so-called "actual state" is particularly advantageous, because the permanent magnet can thereupon, if necessary, be moved by a suitable actuation of the mechanism into a position suitable for the electronic seal.

If the object to be monitored is, for example, a container and the manipulation-significant part is a flap associated therewith, a first action will thus typically consist of firstly opening the flap of the container. In the open state, the flap can interact with the mechanism, for example, via its actuator embodied in a suitable structural form, such that writing of the magnetic data memory is not possible, because the permanent magnet is then automatically located in the vicinity of the magnetic data memory in the case of such a suitable structural form. The container is filled manually or automatically with the content provided for it in this state. In this state, sealing is thus advantageously not yet possible. This state, as already mentioned, can be checked visually or metrologically and in the case of said suitable is structural form, for example, also by writing and reading procedures carried out as test. The flap is then closed manually or automatically. The permanent magnet is moved in this case to a sufficient distance from the magnetic memory via the mechanism, and therefore the magnetic memory is writable and the container is closed simultaneously.

In method step b.), transmitting and writing of the item of checking information in the magnetic data memory takes place. This can preferably take place via a wireless bidirectional data connection, in particular via an RFID connection between an RFID reader on the monitoring unit side and by an RFID transponder on the side of the magnetic data memory, or at least one RFID chip having an associated antenna connected thereto.

In method step c.), transmitting and writing of the item of checking information into the second data memory takes place, which, as already mentioned, can be arranged in or on the object to be monitored. This can also preferably take place via the wireless bidirectional data connection, in particular the RFID connection, between the RFID reader on the monitoring unit side and by the RFID transponder on the device side. The second data memory can also be arranged in other embodiments, as already mentioned, however, in the monitoring unit, which performs the checking of the electronic seal, or at any other location, and can have a data connection to this monitoring unit at least at the time of the checking of the electronic seal.

A data transmission between the respective monitoring unit and the device via the wireless bidirectional data connection, in particular via the RFID connection, is particularly advantageous, of course, because it substantially simplifies the handling in particular in automated methods. Alternatively thereto, the data transmission can, of course, also take place via a wired interface, which generally has the advantage that the data security is thus somewhat increased.

Following step c2.) is very advantageous to ensure the correct seal and can be considered to be nearly obligatory in particular in the case of electronic sealing methods: It consists in the present method of reading out and comparing, as a test, the content of the magnetic data memory to the content of the second data memory to check the two previously performed data transmissions from the monitoring unit and the respective storage of the checking data in the magnetic data memory and in the second memory. For this purpose, both the content of the magnetic data memory and also the content of the second data memory can thus be read out and can be transmitted to the monitoring unit for the comparison thereof by the monitoring unit. Optionally, however, only the content of the magnetic data memory can also be read out and transmitted to the monitoring unit, if the monitoring unit knows the item of checking information, for example, because it contains the second data memory or is in communication therewith. This step c2.) is used to check the sealing, i.e., to check that the checking data are actually correctly stored in the two data memories, and takes place even before method step d.), i.e., even before the transportation. This optional method step is particularly advantageous because corresponding malfunctions are nearly precluded thereby.

In method step d.) a transportation of the object to a predefined intended location takes place. The monitoring accordingly relates to the transportation. In an alternative embodiment, the object can also remain at a fixed location, i.e., at a fixed geographic position, but does not have to be under continuous supervision. Thus, for example, a letterbox or a night safe experiences additional electronic sealing in this manner, which is not necessarily checked after a completed transportation, but is checked at least after passage of a specific period of time. The possibility of powerless monitoring particularly advantageously benefits the monitoring of the objects to be transported, of course.

In method step e.), readout and comparison of the content of the magnetic data memory to the content of the second data memory takes place to check the electronic seal after the completed transportation. The associated data transmission can also take place in a similar manner via an RFID connection. In one preferred embodiment, both the content of the magnetic data memory and also the content of the second data memory are read out and in particular transmitted in the form of two separate messages to the monitoring unit. The monitoring unit can thereupon compare the contents of the two messages to one another and can conclude the state of the electronic seal from the result of this comparison. However, in an alternative embodiment, only the content of the magnetic data memory can also be read out and transmitted, for example, if the second data memory is located in the monitoring unit itself, for example, or at least has a separate communication with the monitoring unit.

If no manipulation takes place during method step d.), it is thus established in method step e.) that the contents correspond, the seal is thus intact and the method is ended.

However, if a manipulation takes place in d.), i.e., the mechanism is in particular actuated accordingly by unauthorized action during transportation, i.e., in the period of time from the sealing until the checking of the seal, the method is thus supplemented between step d.) and step e.) by the following step d2.):

d2.) destroying the item of checking information by reducing the distance between the permanent magnet and the magnetic data memory by actuating the mechanism.

In one preferred embodiment of the method, the permanent magnet is guided toward the magnetic data memory, in particular by the mechanism. In this case, the permanent magnet is thus movable and the magnetic data memory is fixed in relation to the object and the device. This variant is particularly advantageous because the magnetic data memory is typically restricted in its freedom of movement by electrical connections, for example, electrical connecting cables or conductor tracks, and the permanent magnet is thus typically better suitable for movement. In a further embodiment, however, vice versa, the magnetic data memory can also be guided toward the permanent magnet, for example, by the mechanism, which can be advantageous if the permanent magnet is fixedly attached to the object, for example, for individual structural reasons.

If it is established in step e.), for example by a monitoring unit, that the content of the magnetic data memory differs from the content of the second data memory, an item of information is output by this monitoring unit which states that a manipulation exists or at least cannot be precluded.

In contrast, if it is established in step e.) that the content of the magnetic data memory corresponds to the content of the second data memory, an item of information is output, for example, by the monitoring unit, which states that no manipulation exists.

The data transmissions between the monitoring unit and the device and in particular the transmission of the items of checking information in method step b.) can preferably take place in a password-protected manner. The readout of the content of the magnetic data memory, and the transmission of this content to the communication unit in method step e.) can also take place in a password-protected manner.

Alternatively or additionally, the corresponding data transmission in method step b.) and/or in method step e.) can also take place in encrypted form, to ensure a particularly high level of data protection.

BRIEF DESCRIPTION OF THE DRAWINGS

An exemplary embodiment of the invention is illustrated in the drawings and will be explained in greater detail hereafter. In the figures.

The figures partially contain simplified, schematic illustrations. Identical reference signs are partially used for equivalent, but possibly not identical elements. Various views of equivalent elements can be in different scales.

DETAILED DESCRIPTION OF THE INVENTION

Figure 1A:
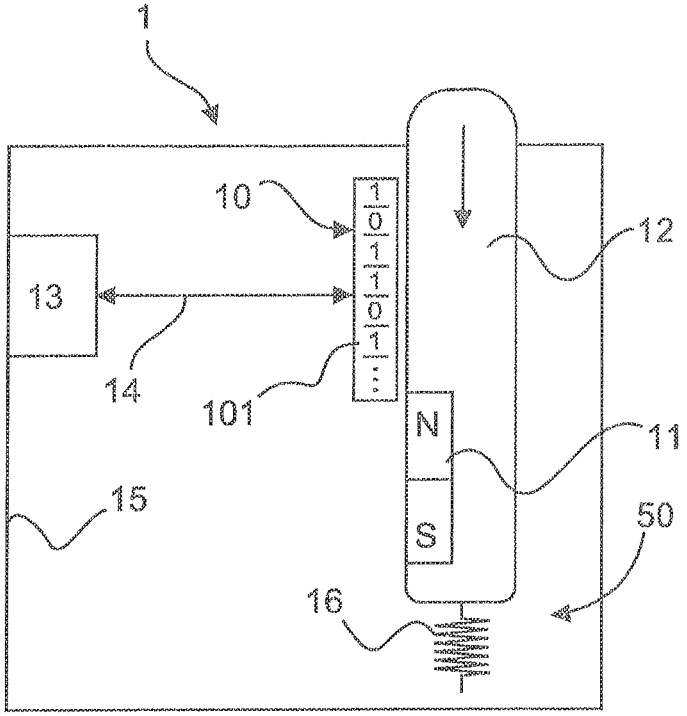
FIGS. 1*a, b* show a device comprising a magnetic data memory, a permanent magnet, and an actuator in an actuated and in a non-actuated state.
Figure 1B:
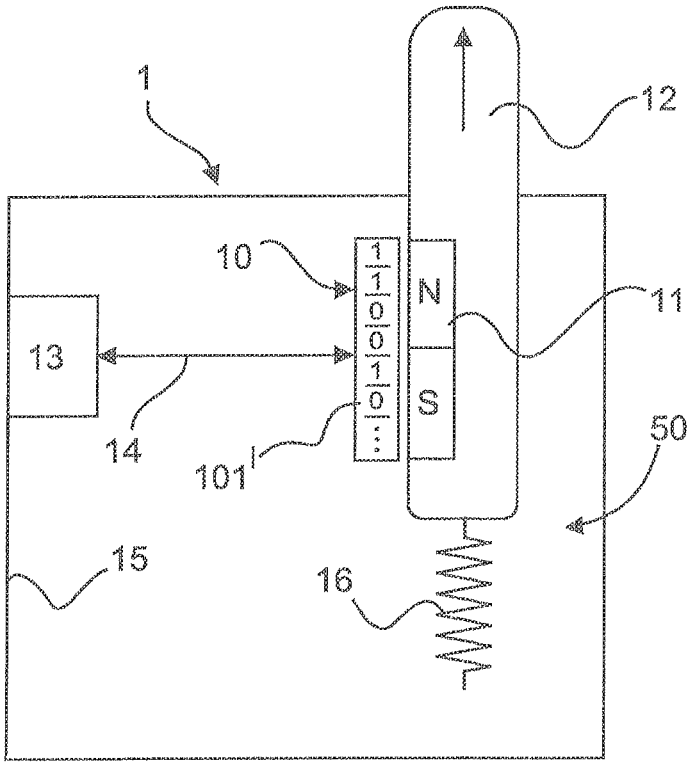

FIG. 1*a* shows a first device 1 in an actuated state; FIG. 1*b* shows the same device 1 in a non-actuated state. The devices 1 described hereafter each have a housing 15 in the embodiments shown. Such a housing 15 can also be omitted in other embodiments.

The device 1 furthermore has a magnetic data memory 10 and a data interface 13, which are in bidirectional data exchange with one another via a data connection 14. An item of information, specifically an item of checking information 101, has already been written in the magnetic data memory 10 via the data interface 13 in the present case.

Furthermore, the device 1 has a permanent magnet 11, which can be moved into the vicinity of the magnetic data memory via a mechanism. In the present example, the mechanism consists of an actuator 12, on which the permanent magnet 11 is arranged. The actuator 12 furthermore has a spring element 16. The actuator 12, and therefore also the device, are in an actuated state when the spring element 16, as shown in FIG. 1*a*, is under mechanical tension. In this case, the spring element 16, which can be, for example, a coiled spring or also a leaf spring or any other suitable type of spring, is compressed. If the actuator 12 is released, it thus moves automatically into the non-actuated position shown in FIG. 1*b*, in which the spring 16 is relaxed.

The non-actuated position is defined in this embodiment in that the permanent magnet 11 is located in the vicinity of the magnetic data memory 10, namely is arranged close enough thereto that its magnetic field is capable of destroying the information stored in the magnetic data memory 10. The content of the magnetic data memory 10 is then replaced by any random numeric sequence 101'. By pressing down the actuator 12 again, of course, the actuated position according to the definition, as shown in FIG. 1*a*, can be mechanically reestablished. The item of checking information 101 remains destroyed, however. The device 1 is therefore capable for this purpose of primarily irreversibly maintaining a conversion from the actuated into the non-actuated state even in an at least temporarily powerless state. For this purpose, it is particularly advantageous if the item of checking information 101 is correspondingly large and therefore can be considered to be unique, because thus a random correspondence with a random number 101', 101", . . . is nearly precluded.

Figure 2A:
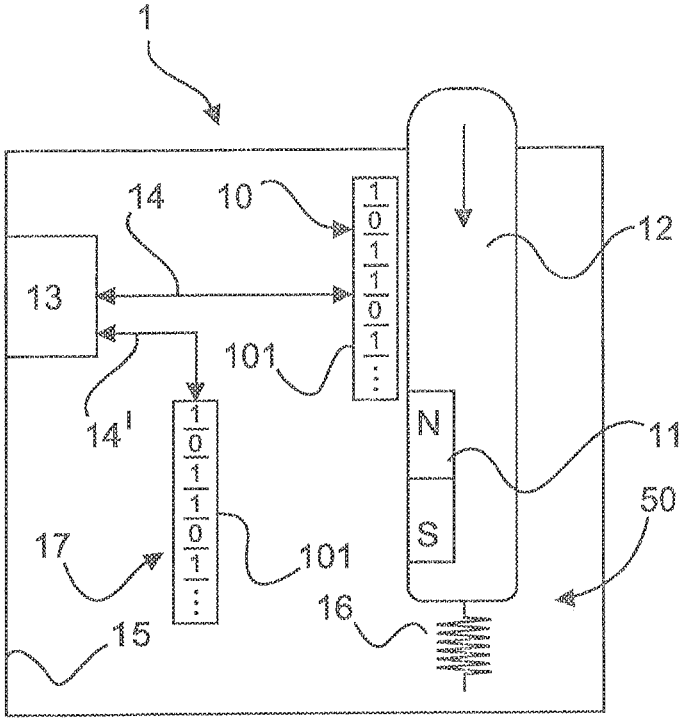
FIGS. 2*a, b* show the actuated and non-actuated device comprising an additional second data memory.
Figure 2B:
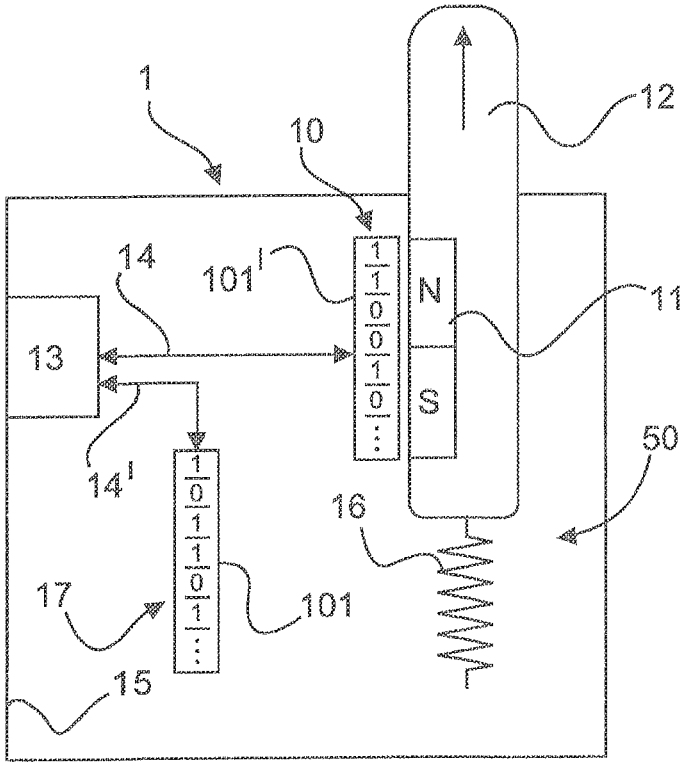

FIGS. 2*a* and 2*b* show a second device 1, also in an actuated and a non-actuated state. This second device differs from the abovementioned device in that it has a second memory 17. This second memory 17 can be arranged separately from the magnetic data memory 10 in its geometrical position. Alternatively or additionally, the second data memory 17 can be a memory type which is resistant to magnetic fields. For example, the second data memory 17 can be an EPROM, an EEPROM, a flash memory, an F-RAM, or an S-RAM.

This second data memory 17 is in bidirectional data exchange with the data interface 13 via a second data connection 14'. In addition, the item of checking information 101 can also be written in the second data memory 17. In contrast to the case of the magnetic data memory 10, the item of checking information 101 of the second data memory 17 is not destructible by the permanent magnet 11. The item of checking information 101 can thus be retained in this manner in the device 1 itself, in order to be compared to the content of the magnetic data memory 10, for example, at a later point in time.

For a particularly good safeguard against possible errors, the two data memories 10, 17 are not in data exchange with one another in this embodiment, but rather are each in data exchange via a separate data connection 14, 14' with the data interface 13.

Figure 3A:
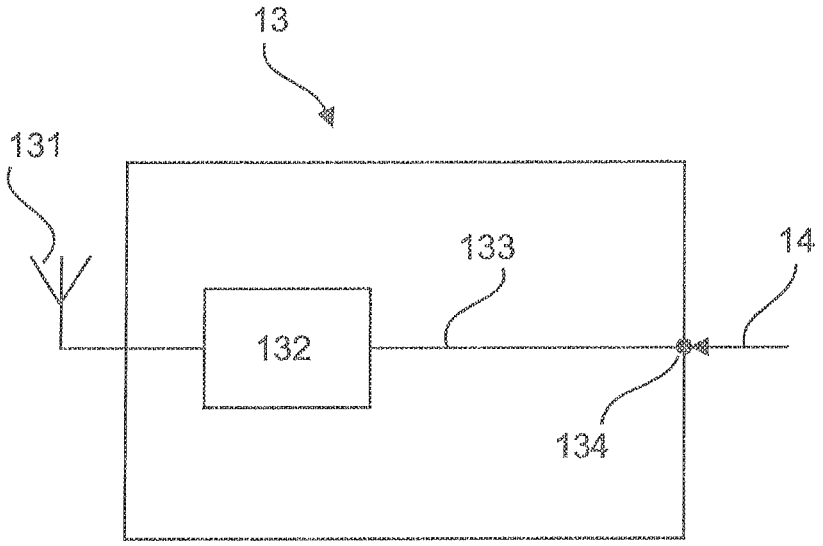
FIGS. 3*a-c* show an associated data interface in various embodiments.
Figure 3B:
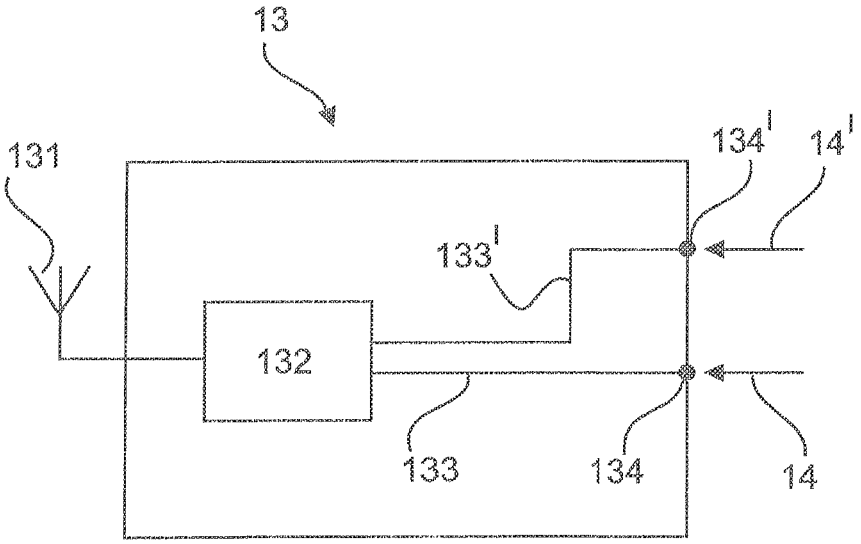
Figure 3C:
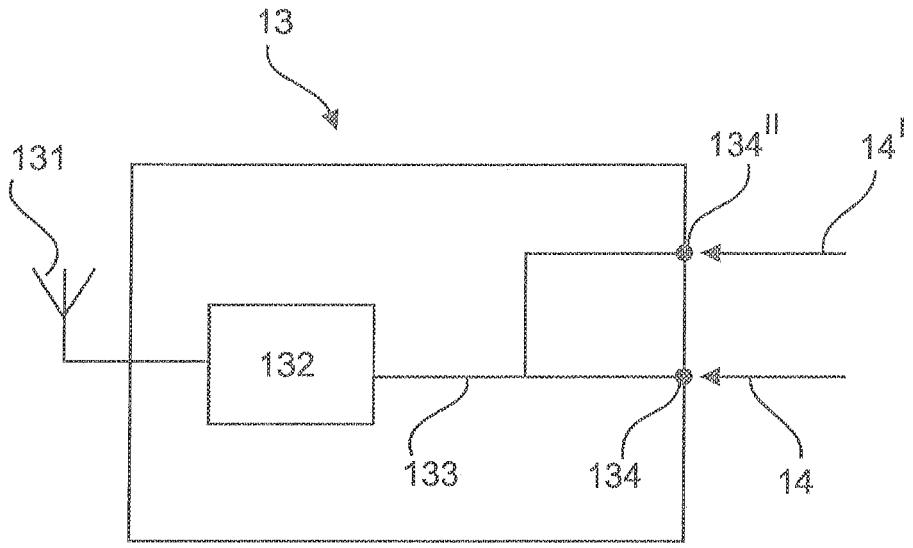

FIGS. 3*a*, 3*b*, and 3*c* show the data interface 13 in slightly different variants. In all three variants, it has an RFID chip 132, which is connected to an associated antenna 131. In the first variant, the RFID chip 132 is guided via a first internal line 133 to a first terminal 134. In the second variant, the RFID chip 132 has a second terminal (not shown in greater detail), which is connected via a second internal data line 133' to an associated terminal of the data interface 134'. In the third variant, the terminal of the RFID chip 132 is distributed to two terminals 134, 134" of the data interface. These three variants can be used for the purpose of separating the data connections to the magnetic data memory 10 and to the second data memory 17 from one another to avoid errors. Instead of the RFID chip 132, another input/output component could also be used, for example, a wired USB component or a wireless Bluetooth component comprising an associated antenna.

Figure 3D:
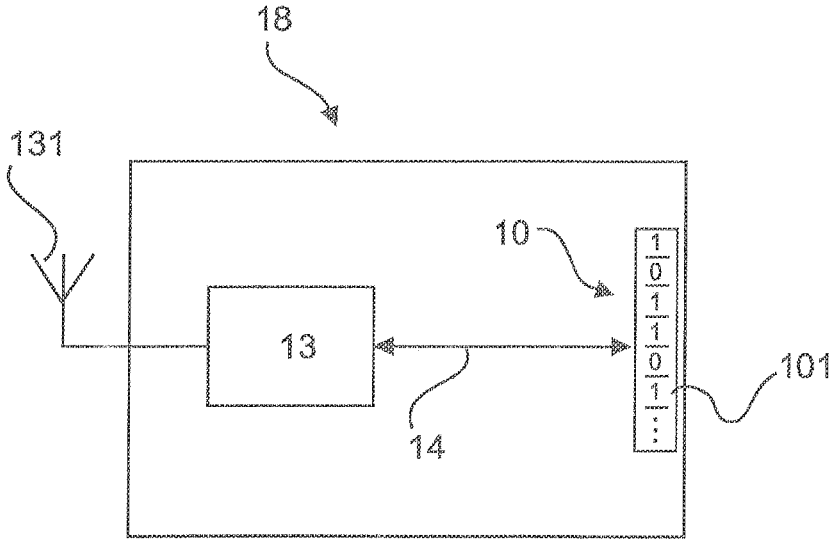
FIG. 3*d* shows an integrated component, comprising the data interface and the magnetic data memory.
Figure 3E:
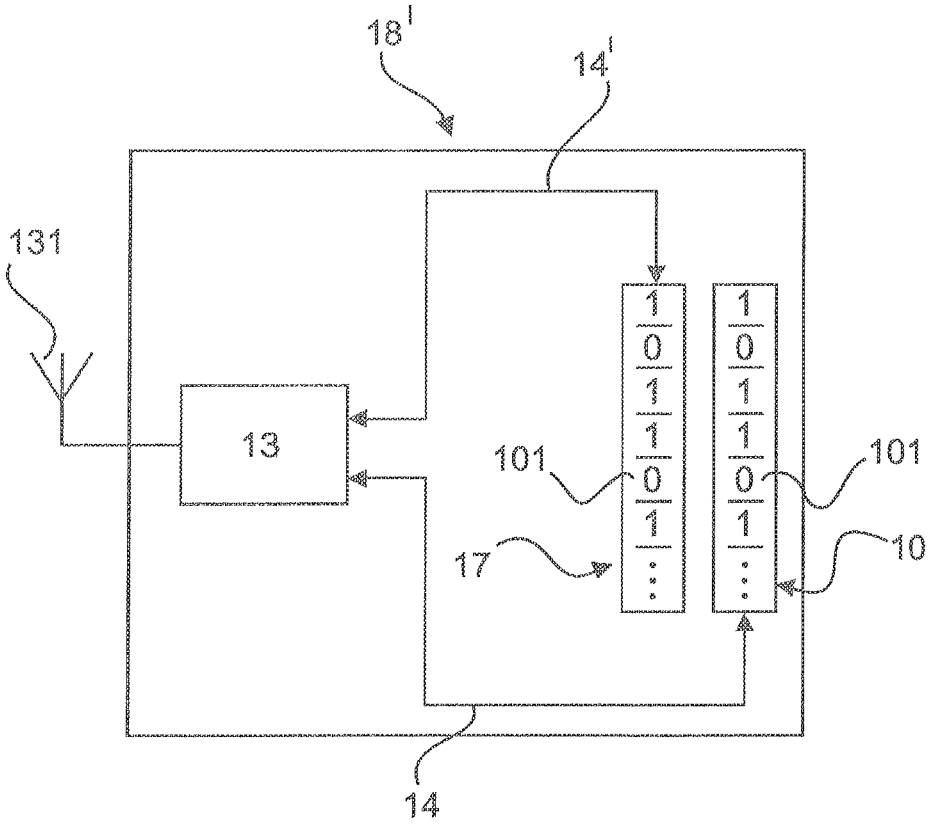
FIG. 3*e* shows the integrated component, additionally comprising the second data memory.

FIG. 3*d* shows an integrated component 18, in which, in addition to the data interface 13, the magnetic data memory 10 is also arranged. FIG. 3*e* shows the integrated component 18', in which the second data memory 17 is additionally also integrated. This means that both the magnetic data memory 10 and also the second data memory 17 are arranged together with the data interface 13 in this integrated component 18' and are advantageously embodied as a common assembly and in particular as an integrated circuit. The two data memories 10, 17 are advantageously in bidirectional data exchange in this case via a separate data connection 14, 14', respectively, with the data interface 13 and thus with the RFID chip 132. In this case, the data interface 13 and in particular the RFID chip 132 can have a microprocessor, which assumes the control of the data traffic, for example. The integrated component 18, 18', which is embodied as an integrated circuit in particular, can also have an additional microprocessor for such tasks, however. A geometrical separation of the two data memories 10, 17 is not particularly advisable in this structural form for reasons of space. The second data memory 17 is thus preferably a memory type which is resistant to magnetic fields for the mentioned reasons. The second data memory 17 can thus particularly preferably be an EPROM, an EEPROM, a flash memory, an F-RAM, or an S-RAM.

Figure 4A:
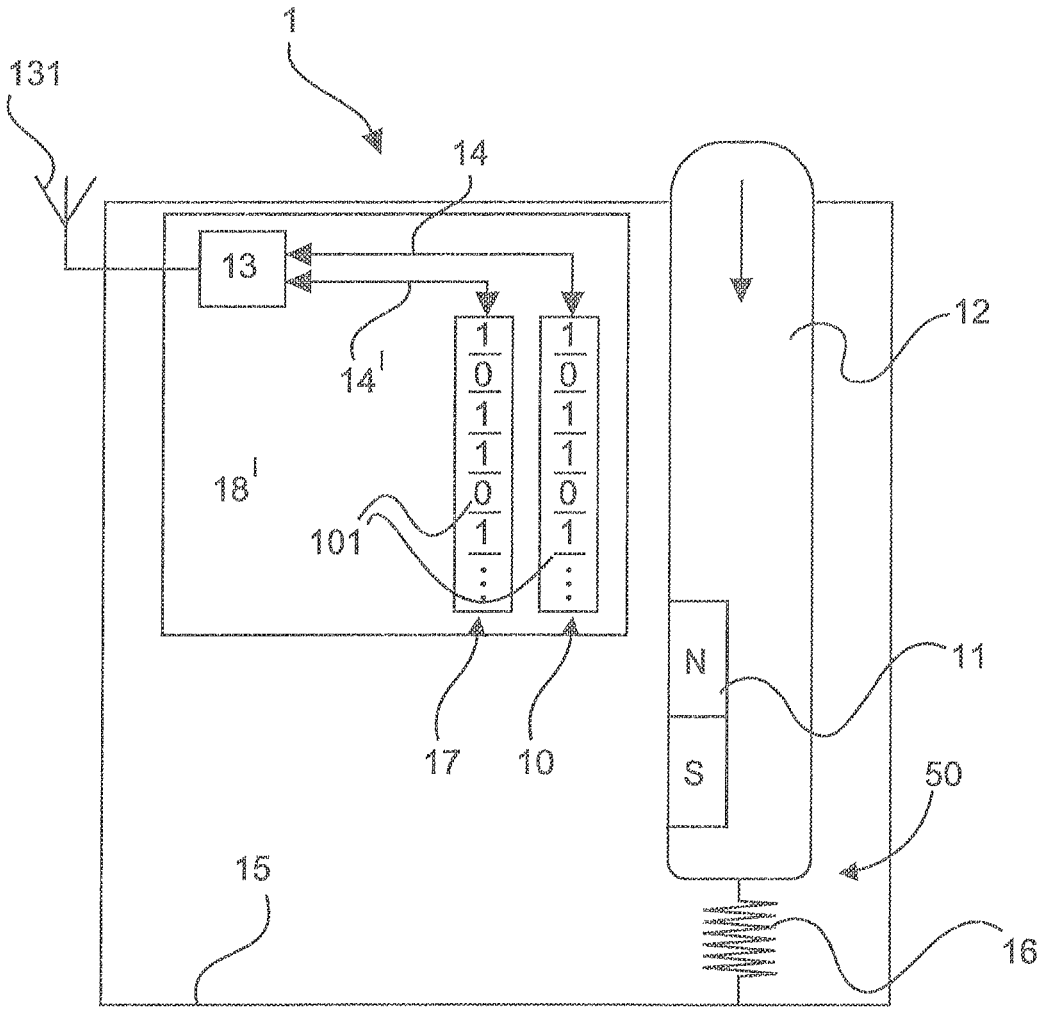
FIGS. 4*a, b* show the device comprising the integrated component in an actuated and a non-actuated state.
Figure 4B:
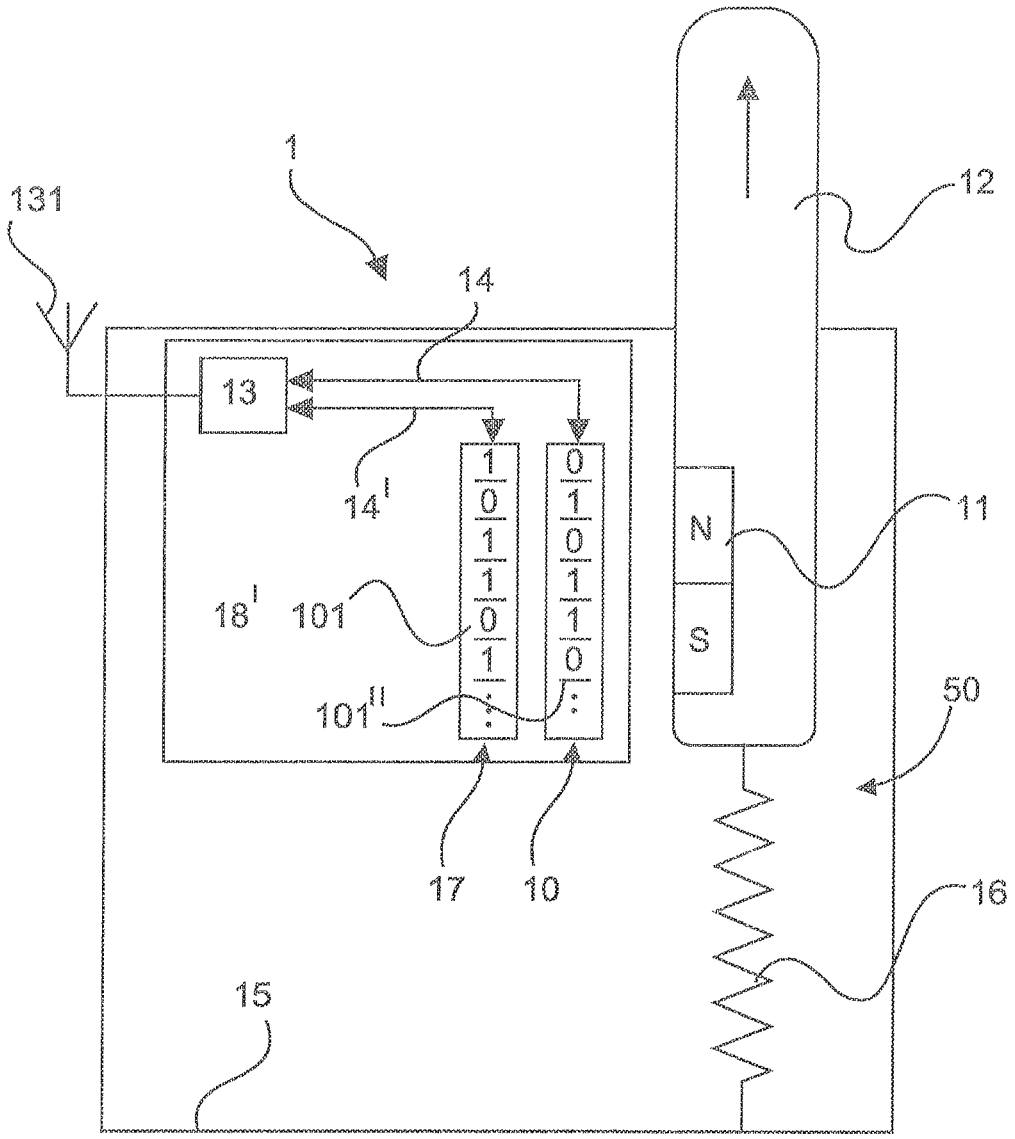
FIGS. 4*c, d* show an open and closed transportation box comprising a device arranged therein in a non-actuated and an actuated state.
FIGS. 4*e, f* show a closed transportation box comprising a particularly sabotage-resistant device.
FIGS. 4*g-m* show a padlock-type device.
FIGS. 4*n, o* show an associated actuator.
FIG. 4*p* shows a transportation box comprising a closure and the padlock-type device.

FIGS. 4*a* and 4*b* show, as a further variant, a device 1, which has such an integrated component 18', wherein the actuator 12 is in the actuated position in FIG. 4*a*. In FIG. 4*b*, in contrast, a release of the actuator 12 has taken place, and therefore the spring element 16 relaxes and the permanent magnet 11 is guided into the vicinity of the magnetic data memory 10, to destroy the item of information thereof. A further random number 101" is now in the magnetic data memory 10, while the item of checking information 101 is still retained unchanged in the second data memory 17.

Figure 4C:
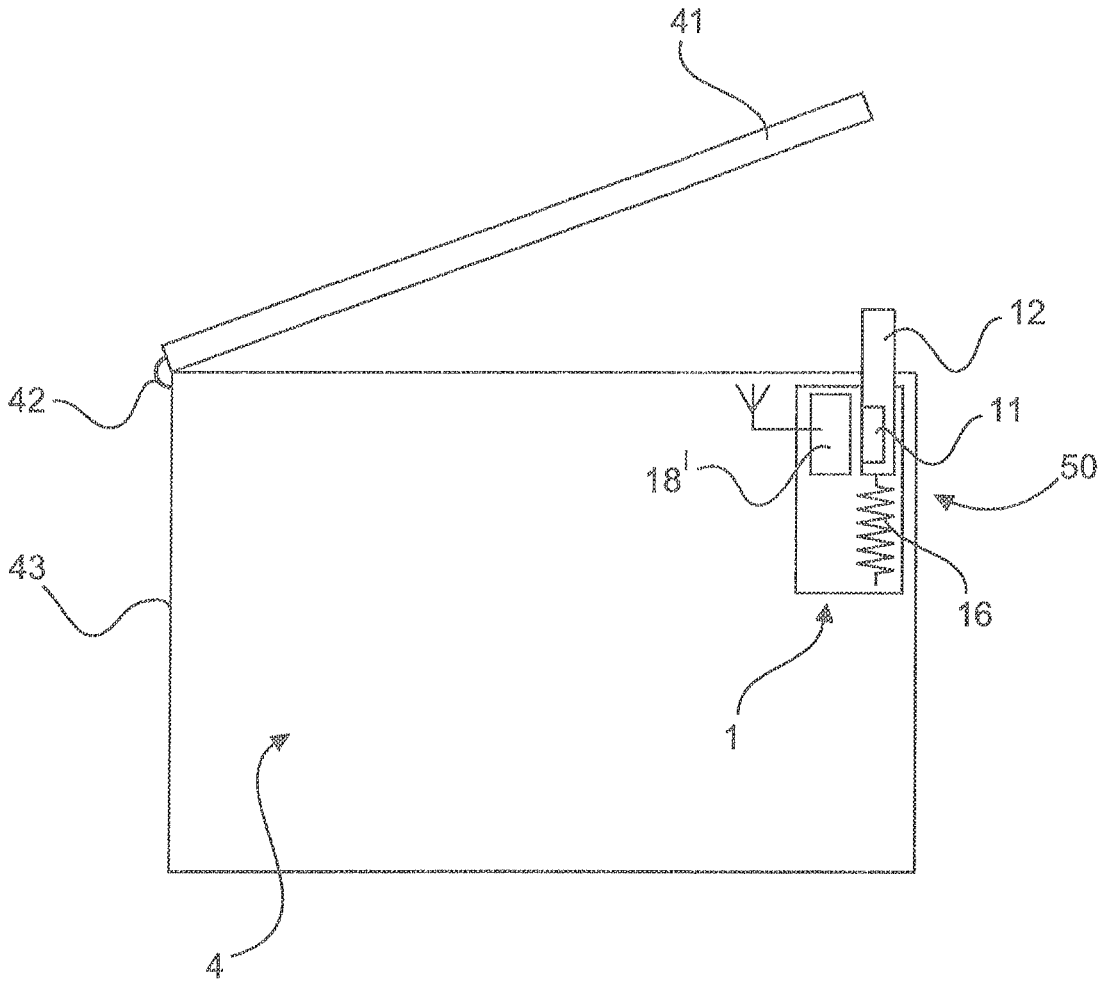
Figure 4D:
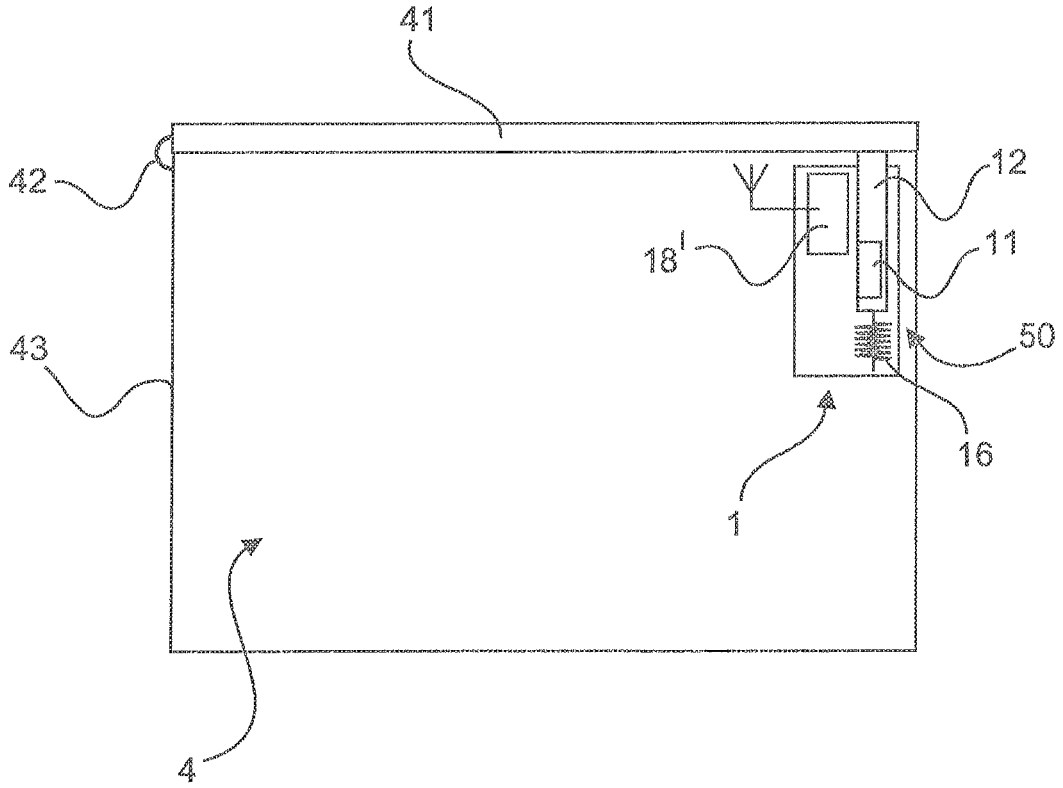

FIGS. 4*c* and 4*d* show a transportation box 4 comprising a flap 41 in the open and closed states. The flap 41 is fastened via a hinge 42 on a hinge side 43 of the transportation box 4 and can be considered to be a manipulation-significant part for the transportation box 4. The device 1 is therefore arranged in the transportation box 4 such that closing of the flap 41 automatically results in actuation of the actuator 12. In the open state of the transportation box 4, as shown in FIG. 4*c*, the magnetic memory 10 of the integrated component 18 thus cannot be written. Writing the magnetic data memory 10 for the purpose of electronic sealing is only possible in a closed state of the transportation box 4, as shown by way of example in FIG. 4*d*.

It is apparent that the illustrations shown in FIGS. 4*c* and 4*d* are rough simplified schematic sketches, which at least permit the possibility of sabotage, or even make it obvious. However, a plurality of alternative embodiments is also possible, by which a principle according to the invention may be mechanically protected substantially better again sabotage. For example, in an alternative embodiment, which is shown in enlarged form in FIG. 4*e* and FIG. 4*f*, the actuator 12 can also be embodied as a rotating mechanism (shown by dashed lines) and can be fixedly connected to the flap 41, while the further device comprising its housing 15 and the magnetic data memory 10, which can be located in particular in the integrated component 18', is attached to the hinge side 43 of the transportation box 4. By opening the flap 41, a mechanism is then actuated, which moves the permanent magnet 11 in the direction of the arrow toward the integrated component 18' and thus toward the magnetic data memory 10. By particularly fine adjustment, the permanent magnet 11 can release the magnetic data memory 10 only upon complete closing of the flap 41 and can immediately destroy it upon slight opening. Furthermore, the transportation box 4 and in particular the flap 41 can be embodied in such a way that such a slight opening does not yet permit access to the content of the transportation box.

Figure 4E:
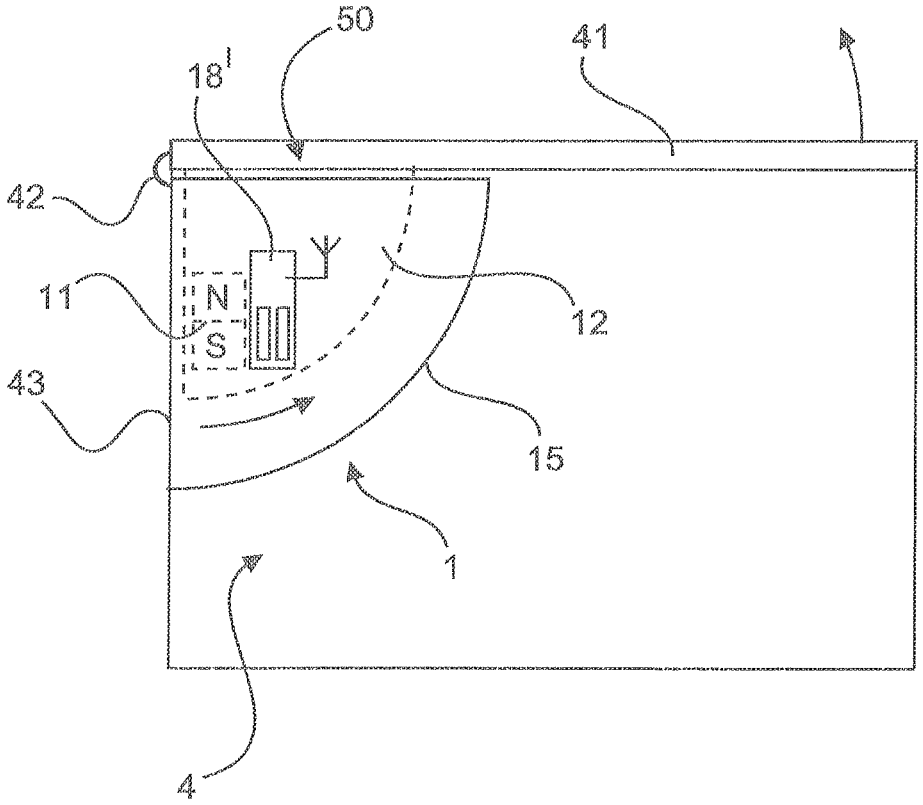
Figure 4F:
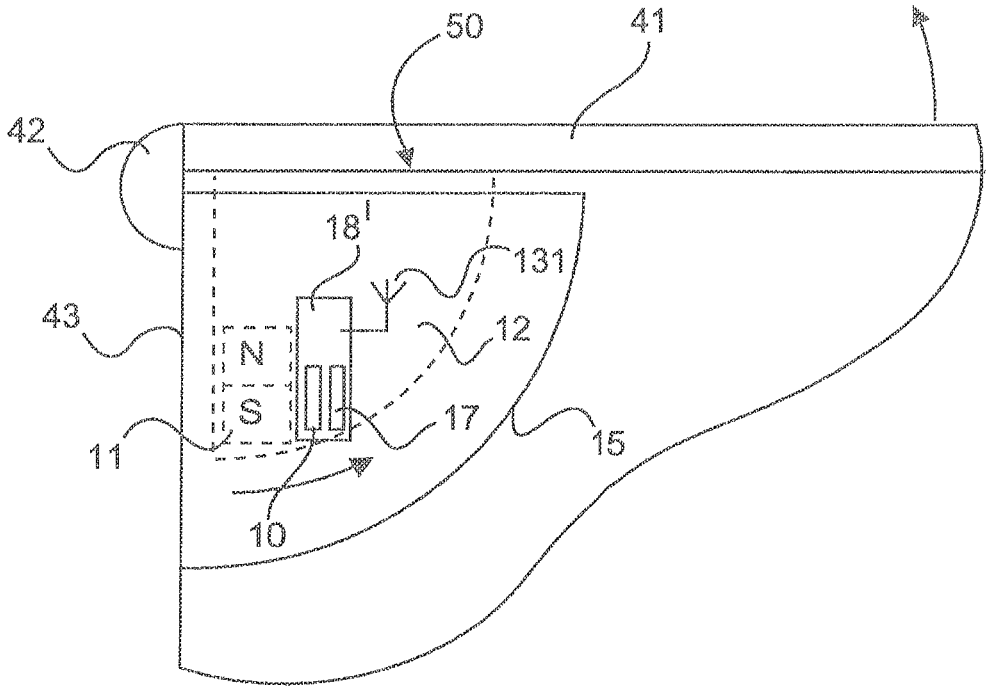

The arrangement shown in FIG. 4*e* and FIG. 4*f* is particularly advantageous, because the magnetic data memory 10 can be located particularly well protected in this case, low on the hinge side 43 in the transportation box 4. The movement radius of the permanent magnet 11 can also be restricted in this manner to a required minimum. The permanent magnet 11 also does not have to be embodied in the form of a circular segment for this purpose, but rather solely has to have a sufficient size and be arranged at a suitable point of the actuator 12 to overshoot the region which is covered by the magnetic data memory 10 upon its actuation. A spring element 16 can also be omitted in this embodiment. The permanent magnet 11 and the magnetic memory 10 are located in the outwardly closed housing 15, and therefore a forceful engagement on the housing 15 of the device 1 would destroy them and would thus also be recognized as manipulation.

In a further embodiment (not shown in the drawing), the device 1 can also be introduced into a closure mechanism of the transportation box 4, and thus can be automatically actuated upon closing of the transportation box 4.

Figure 4G:
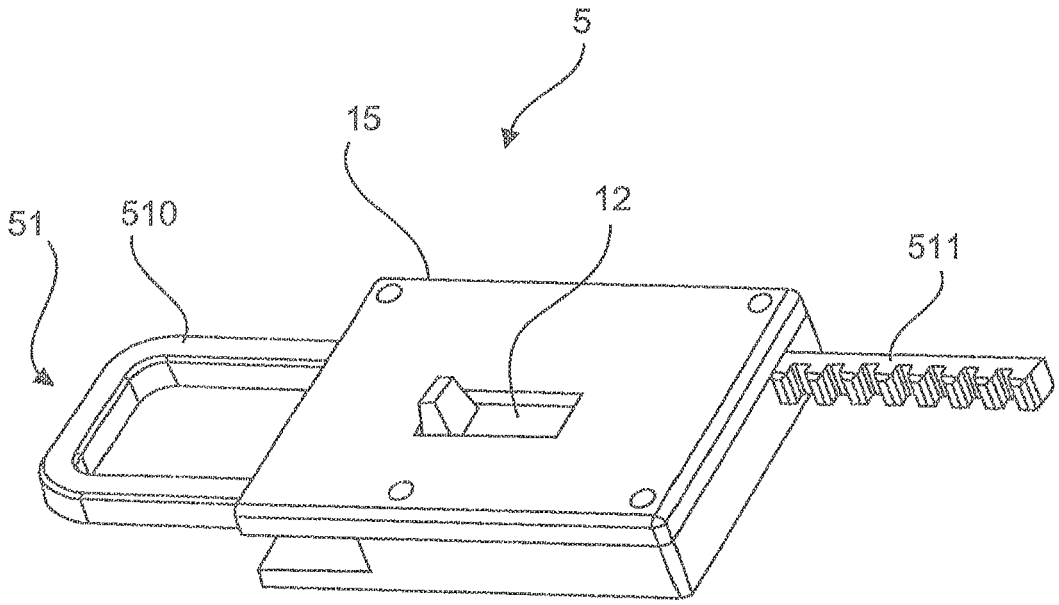

FIG. 4*g* shows a padlock-type device 5. It has a housing 15 and an actuator 12, which is shown once again explicitly from various views and described in detail in FIGS. 4*n* and 4*o*. The housing 15 has a window (not shown in greater detail), through which a handle 121 of the actuator 12 protrudes out of the housing 15. Furthermore, this device 5 has a bracket 51, which has a curved region 510 at a first end and a locking region in the form of a toothed rack 511 at the other end.

Figure 4H:
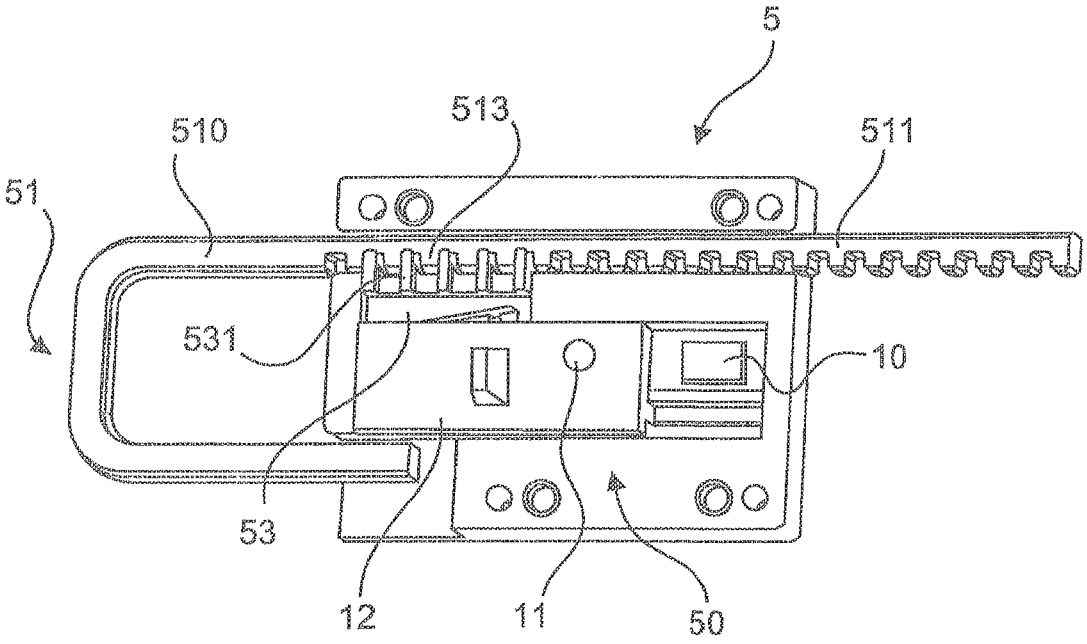

FIG. 4*h* shows a possible mechanism 50, comprising the actuator 12, the bracket 51, and a locking element 53. The toothed rack 511 of the actuator 51 has teeth 513, which are spaced apart from one another by intermediate spaces. The locking element 53 has multiple counter teeth 531, which engage for locking in the intermediate spaces of the teeth 513 of the toothed rack 511. The actuator 12 is initially located in a locked position in this illustration.

Figure 4I:
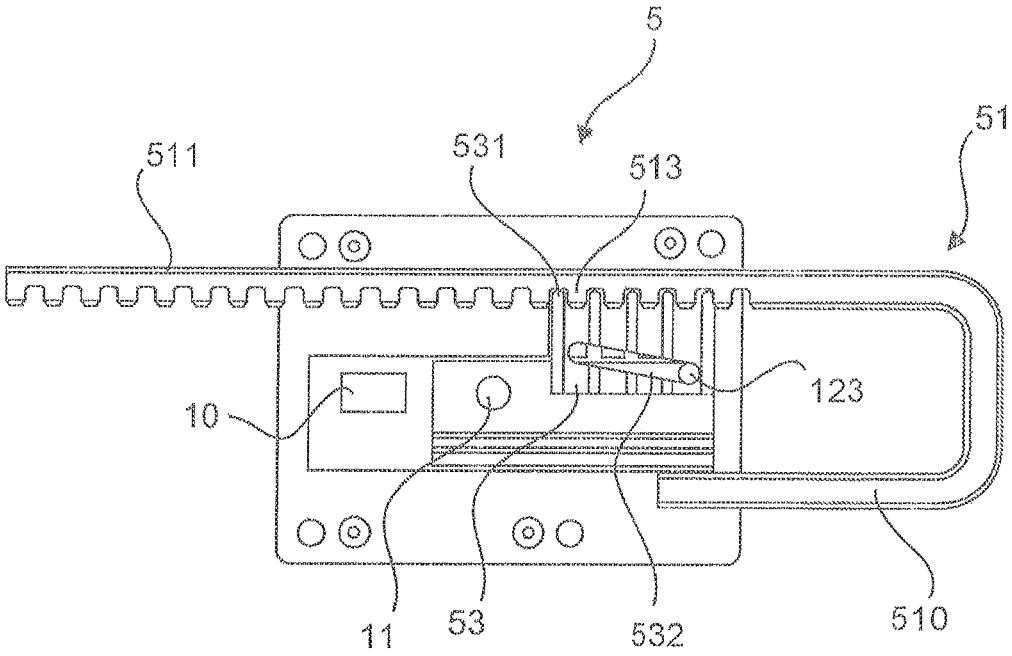
Figure 4J:
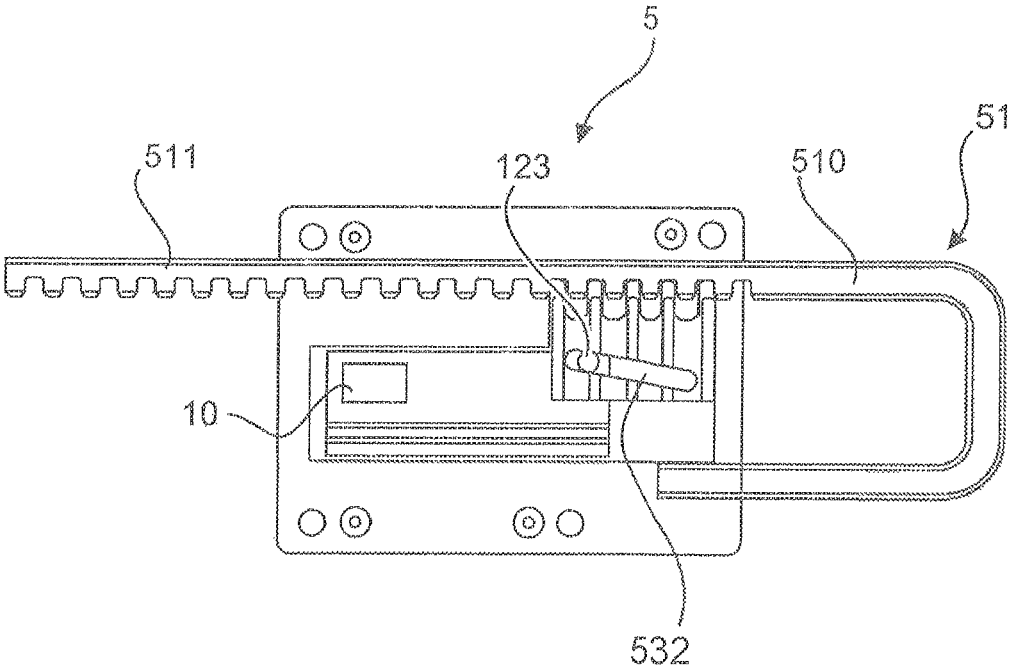
Figure 4K:
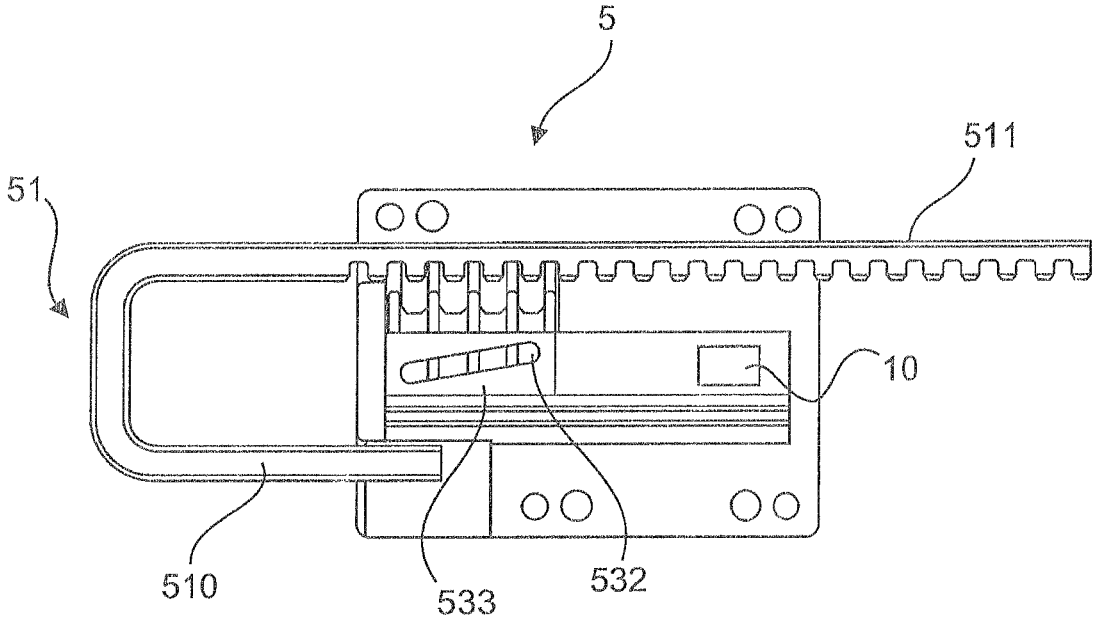
Figure 4L:
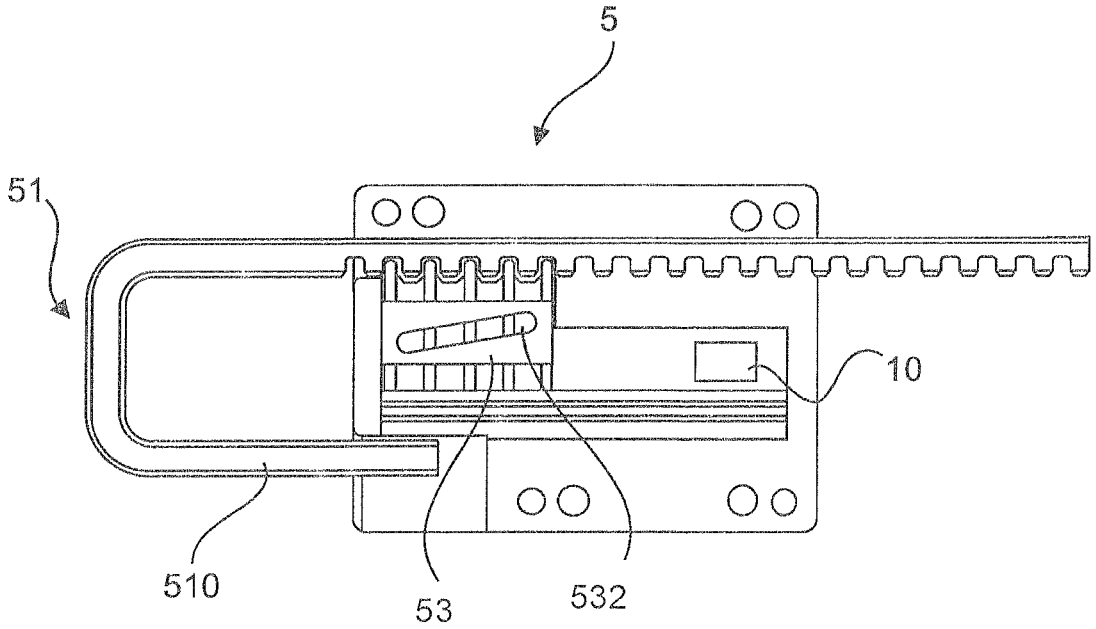
Figure 4M:
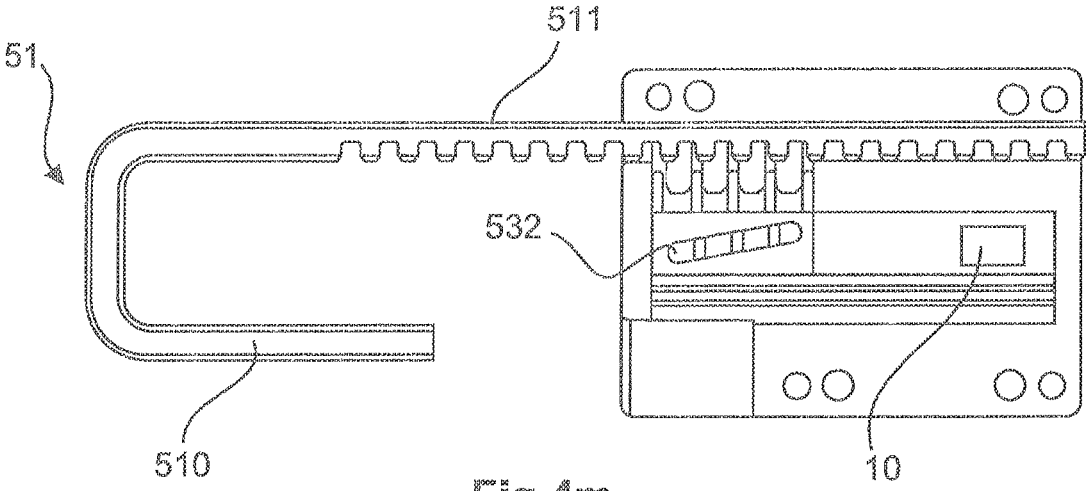

The actuator 12 can, as shown in FIGS. 4*i* and 4*j* from the opposite direction, be displaced by a translational movement in the movement direction of the bracket 51. FIGS. 4*k* and 4*l* show the reverse locking process from the original direction again, wherein the actuator 12 is removed in this view to enable a free view of the further parts 51, 53 of the mechanism. If this movement takes place in an unlocking direction, the permanent magnet 11 arranged on the actuator 12 thus comes to rest above the magnetic data memory 10. At the same time, the locking element 53 is pulled away from the toothed rack of the locking bracket 51 by means of an unlocking pin 123 of the actuator 12, which engages in an inclined slot 532 of the unlocking element 53 for this purpose. The bracket 51 is thus released and can be pulled with its curved region 510, as shown in FIG. 4*m*, out of the housing 15, to open the padlock-type device 5.

Figure 4N:
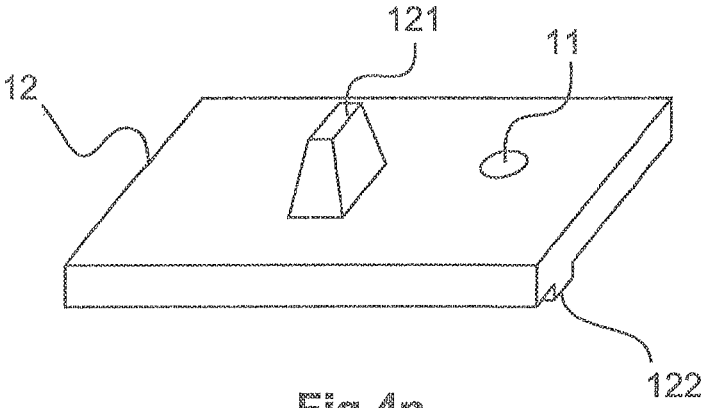
Figure 4O:
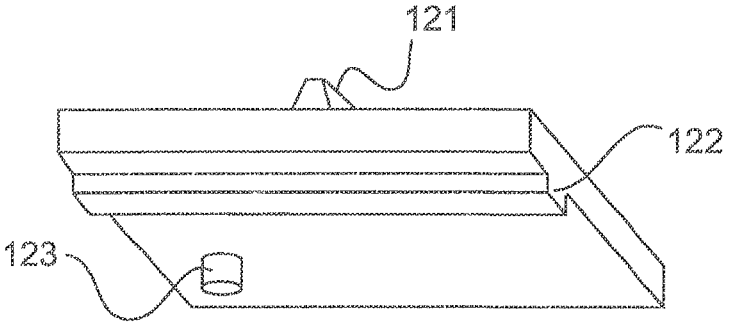

FIGS. 4*n* and 4*o* show the actuator 12 with its handle 121 from two different perspectives. A rail 122, which is provided for the purpose of engaging in a groove (not shown) of the housing 15, can be seen particularly well in FIG. 4*o*.

Figure 4P:
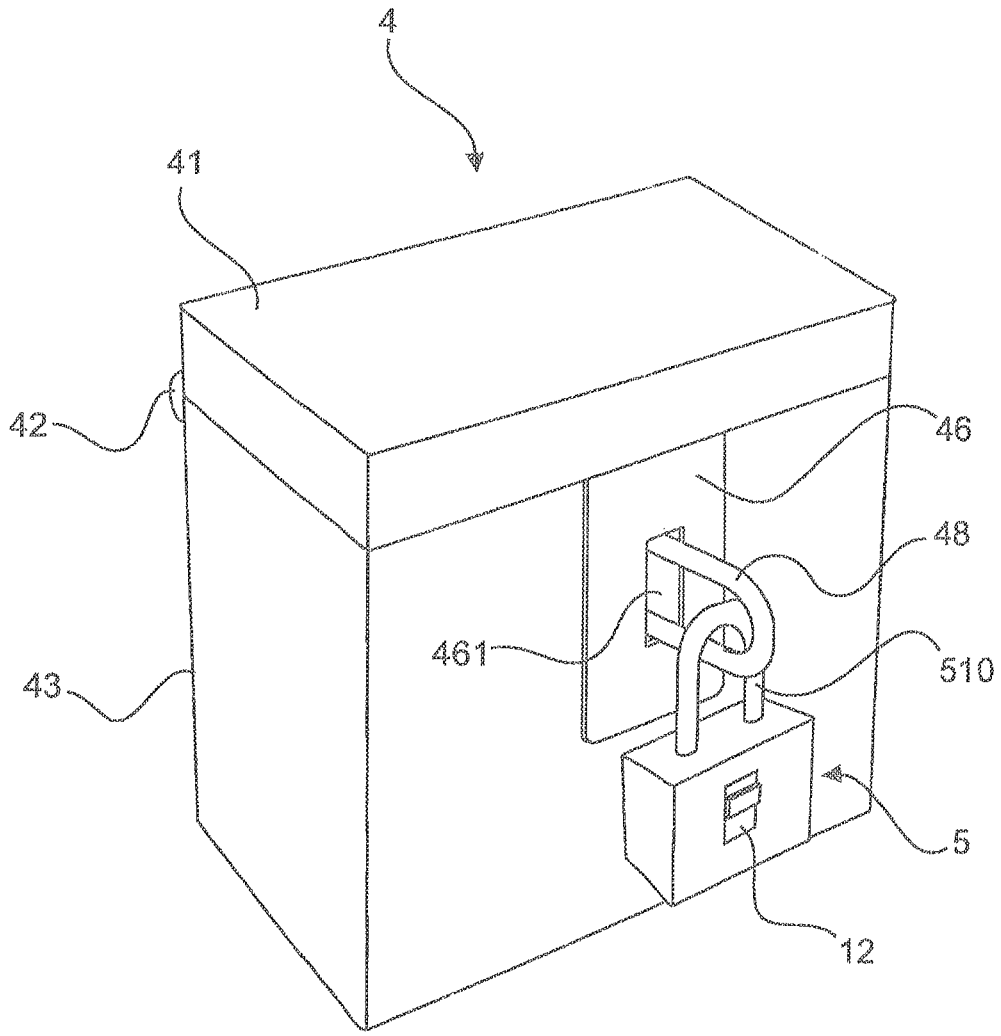

FIG. 4*p* shows a transportation box 4 comprising a symbolically indicated closure, which is typically provided for use with a padlock. Of course, any other closure which is typically provided for use with a padlock is also suitable for use with the padlock-type device 5 in other embodiments.

The symbolically indicated closure will be described hereafter on the basis of FIG. 4*p* by way of example as the following arrangement: a tab 46, which has a slot 461, is attached to the cover 41 of the transportation box 4. Furthermore, the transportation box 4 has an eye 48, which engages through the slot 461 when the cover 4 is closed. In this state, the open bracket 51 can be guided with its curved region 510 through the eye 48 and the padlock-type device 5 can thereupon be closed and electronically sealed, and therefore opening of the transportation box 4 is no longer possible without destroying the electronic seal.

Figure 5A:
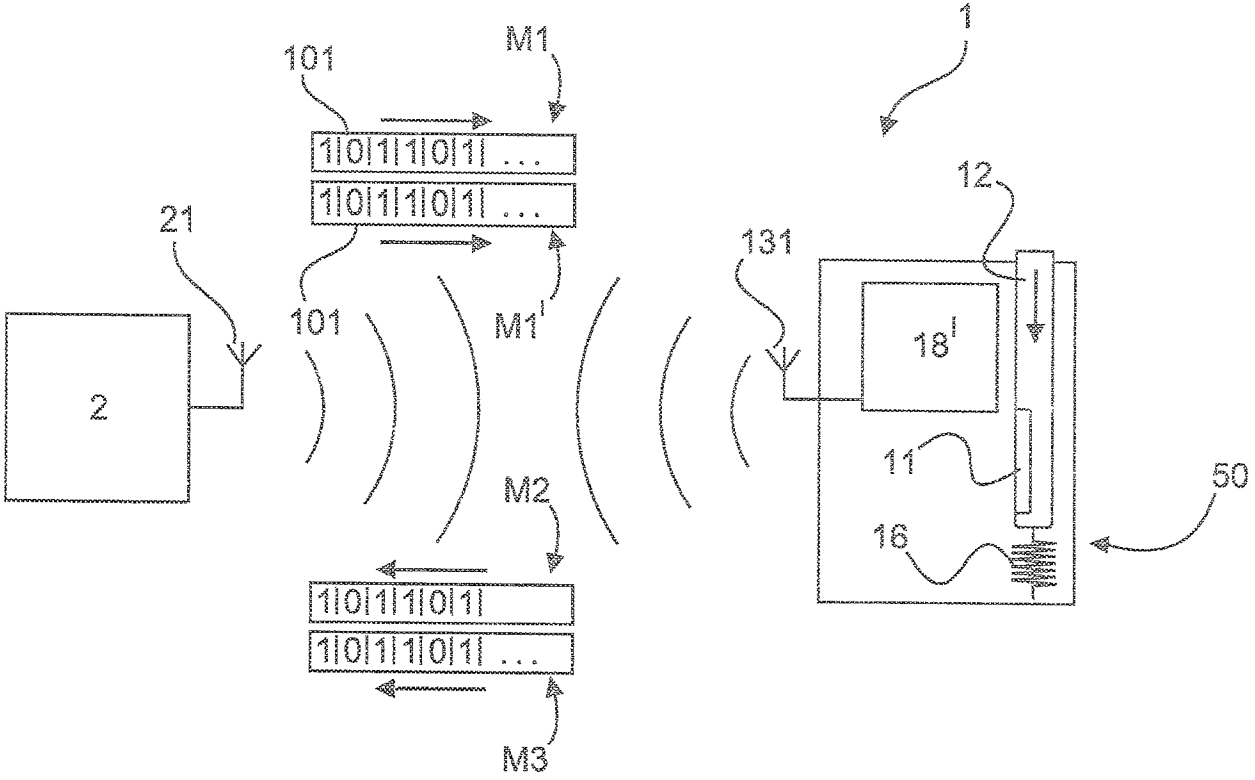
FIG. 5*a* shows a first data exchange between a monitoring unit and the device.

FIG. 5*a* shows a first data transmission between a monitoring unit 2 and the device 1. The actuator 12 of the device 1 is moved into an actuated position, in which, for example, the flap 41 of the previously filled transportation box 4 is closed. A first message M1 is then transmitted to the device 1 by the first monitoring unit 2 via the antenna 21 thereof. This message M1 contains an item of checking information 101.

In the present case, the data transmissions take place wirelessly via the RFID connection. This preferably occurs in a password-protected and/or encrypted manner. However, other wireless or wired transmission pathways are also possible in other embodiments instead of the RFID connection, e.g., Bluetooth or USB.

The device has, in addition to the actuator 12 comprising its spring element 16 and the permanent magnet 11, an integrated component 18', which comprises the RFID chip 132 (not explicitly shown here) and the associated antenna 131 and also the magnetic data memory 10 and the second data memory 17. In its most rudimentary design, the device merely has to have any type of data interface 13, the magnetic data memory 10, a permanent magnet 11, and an actuator 12 mechanically coupled thereto, however, so that the method according to the invention can be carried out.

After the transmission of the first message M1, the device 1 could write the transmitted item of checking information 101 both in its magnetic data memory 10 and also in its second data memory 17. In practice, however, two messages M1, M1' having the same content, namely the item of checking information 101, but different addresses and/or instructions are typically transmitted by the monitoring unit, in particular via an associated RFID reader, to the device. Accordingly, the content 101 of the one message M1 is written by the device in the magnetic data memory and the content 101 identical thereto of the other message M1' is written in the second data memory. This corresponds to electronic sealing.

Optionally, firstly the following check is provided thereupon: For the check, the device 1 transmits the content of both data memories 10, 17 back to the first monitoring unit 2, in particular in the form of two separate messages M2, M3. The first monitoring unit 2 can therefore check once again whether the contents thereof correspond to one another and in particular also whether they correspond to the originally transmitted item of checking information 101. This corresponds to a check of the electronic seal. If necessary, the sealing procedure can be repeated. However, the contents will typically correspond.

Figure 5B:
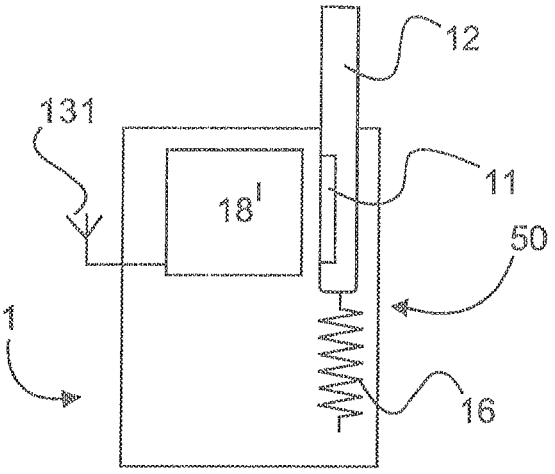
FIG. 5*b* shows the device in a non-actuated state.

The device 1 can now be transported together with the object to be monitored, in the present case thus the transportation box 4, in which it is arranged. If, as shown in FIG. 5*b*, a transition of the actuator 12 into the non-actuated state takes place, in particular during the transportation, as shown in FIG. 4*c*, for example, i.e., opening of the flap 41 of the transportation box 4, for example, the permanent magnet 11 is thus guided to the integrated component 18' and thus to the magnetic memory 10. The content 101 of the magnetic memory 10 is thus destroyed and replaced by any random number 101".

Figure 5C:
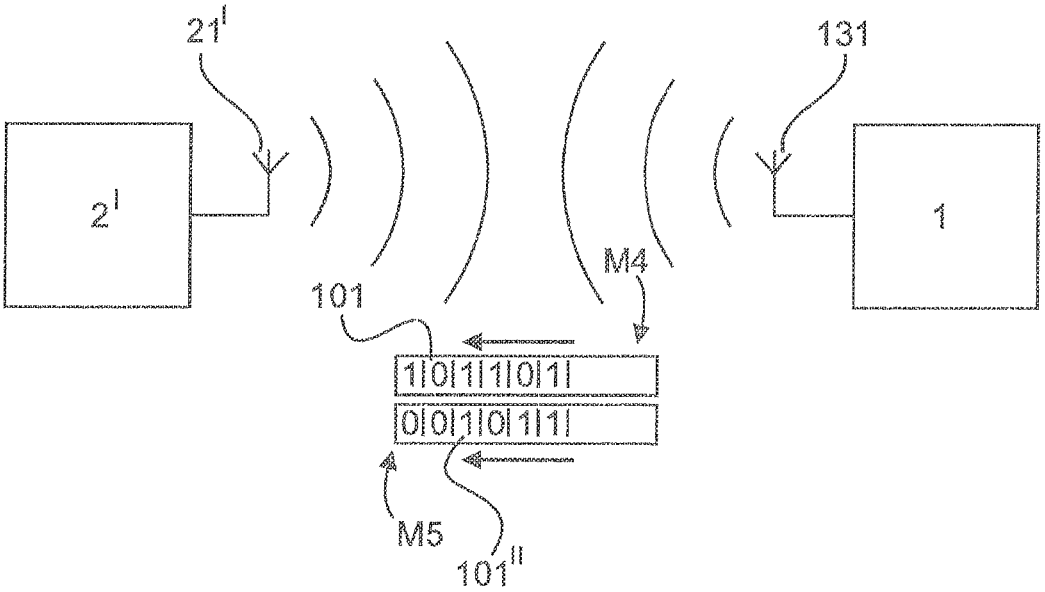
FIG. 5*c* shows a data transmission from the device, which has been put into a non-actuated state in the meantime, to a further monitoring unit.

After the transportation, as shown in FIG. 5*c*, a transmission of the contents 101, 101' of the two data memories, namely of the magnetic data memory 10 and of the second data memory 17, takes place again, preferably in the form of two further separate messages M4, M5 to a further monitoring unit 2'. This further monitoring unit 2' can be in particular structurally equivalent to the abovementioned monitoring unit 2. This data transmission also takes place in particular in a password-protected and/or encrypted manner.

All data transmissions between the respective monitoring unit 2, 2' and the device 1 preferably take place in a password-protected and/or encrypted manner, to ensure particularly good data security.

Figure 6:
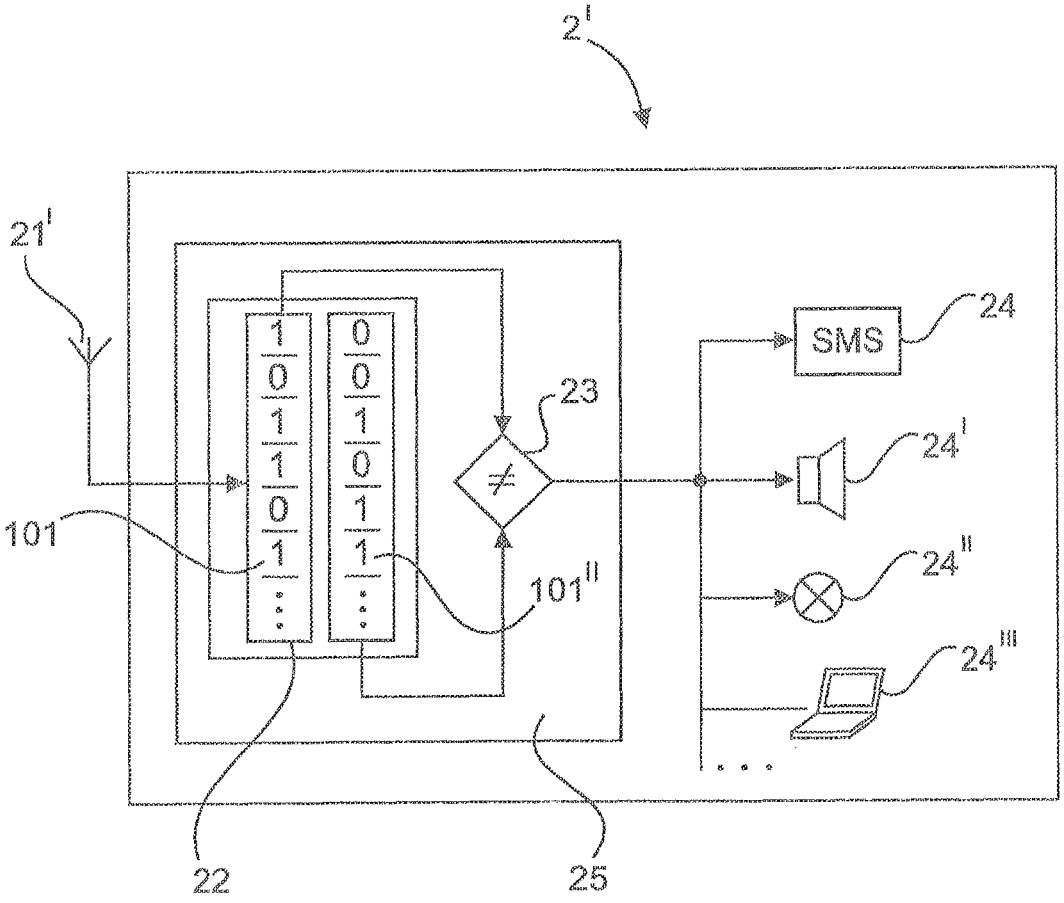
FIG. 6 shows an analysis of the transmitted data by the further monitoring unit.

FIG. 6 explicitly shows how the further monitoring unit 2' stores the contents 101, 101" of the messages M4, M5 received via its antenna 21 in a memory 22 of a processor 25, possibly in encrypted form, and compares the contents thereof via a computer operator 23. This corresponds to the check of the electronic seal.

If these contents do not correspond, as shown in the present case, an alarm is thus triggered via an output unit, for example, via a mobile wireless connection 24 as an SMS, a loudspeaker 24', a light 24", a computer 24", and/or via any other type of suitable device, to thus indicate the destruction of the seal and the presence linked thereto of a manipulation.

The following embodiments are disclosed as further exemplary embodiments:

Embodiment 1 a device for monitoring the manipulation of a transportable object (4), wherein the device (1) comprises the following base elements:

- a magnetic data memory (10) for storing an item of checking information (101);
- a permanent magnet (11) for destroying this item of checking information (101);
- a mechanism (50) for carrying out the destruction of the item of checking information (101) of the magnetic data memory (10) by the permanent magnet (11);
- a data interface (13);
- a data connection (14) between the magnetic data memory (10) and the data interface (13) for the bidirectional data exchange between the magnetic memory (10) and the data interface (13).

Embodiment 2 the device according to embodiment 1, wherein the magnetic data memory (10) is embodied in MRAM ("magnetoresistive random access memory") technology.

Embodiment 3 the device according to any one of the preceding embodiments, wherein said mechanism (50) mechanically interacts with the permanent magnet (11).

Embodiment 4 the device according to any one of the preceding embodiments, wherein the mechanism (12) is capable of reducing the geometrical distance between the permanent magnet (11) and the magnetic data memory (10), to thus destroy the item of checking information (101) stored in the magnetic data memory (10).

Embodiment 5 the device according to any one of the preceding embodiments, wherein the mechanism (50) comprises an actuator (12), on which the permanent magnet (11) is arranged.

Embodiment 6 the device according to embodiment 5, wherein the actuator has a spring element (16), the spring force of which counteracts an actuation of the actuator (12).

Embodiment 7 the device according to either one of embodiments 5 to 6, wherein the device furthermore has a housing (15), in which or on which said base elements of the device (1) are arranged, wherein the actuator (12) is guided at least partially out of the housing (15) for the actuation.

Embodiment 8 the device according to any one of the preceding claims, wherein the device comprises, as a further element, a second data memory (17) for separately storing the item of checking information (101).

Embodiment 9 the device according to embodiment 8, characterized in that the content of the magnetic data memory (10) can be destroyed separately by the permanent magnet (11), wherein the content of the second data memory (17) can be preserved unchanged simultaneously.

Embodiment 10 the device according to either any one of claims 8 to 9, wherein the type of the second data memory (17) differs from the type of the magnetic data memory (10).

Embodiment 11 the device according to any one of embodiments 8 to 10, wherein the second data memory (17) is an EPROM, an EEPROM, a flash memory, an F-RAM, or an S-RAM. 30*o*
Embodiment 12: the device according to any one of embodiments 8 to 11, wherein the magnetic data memory (10) and the second data memory (17) are arranged in an integrated component (18').

Embodiment 13 the device according to embodiment 12, wherein the data interface (13) is additionally also arranged in the integrated component (18').

Embodiment 14 the device according to any one of embodiments 8 to 13, wherein the device has a further separate data connection (14'), via which the second data memory (17) is in a bidirectional data exchange with the data interface (13).

Embodiment 15 the device according to any one of embodiments 8 to 14, wherein the second data memory (17) has a password protection.

Embodiment 16 the device according to any one of the preceding embodiments, wherein the magnetic data memory (10) has a password protection.

Embodiment 17 the device according to any one of the preceding embodiments, wherein the data interface (13) has an encryption and/or a decryption system.

Embodiment 18 the device according to any one of the preceding embodiments, wherein the device (1) comprises means for wireless data transmission.

Embodiment 19 the device according to any one of the preceding embodiments, wherein the device comprises an RFID transponder or at least one RFID chip (132) and an associated antenna (131).

Embodiment 20 the device according to embodiment 19, wherein the RFID chip (132) is part of the data interface (13).

Embodiment 21 a system, comprising a device according to any one of the preceding embodiments, and furthermore comprising the transportable object (4) to be monitored, wherein the transportable object (4) has a manipulation-significant part (41).

Embodiment 22 the system according to embodiment 21, wherein the object to be monitored is a transportation container (4) and the manipulation-significant part (41) is a closure, a cover, a door, a flap (41), a lock, or any other means for opening the transportation container (4) to be monitored for manipulation.

Embodiment 23 the system according to either one of embodiments 21 to 22, wherein the system furthermore comprises a separate monitoring unit (2).

Embodiment 24 the system according to embodiment 23, wherein the monitoring unit (2) has means for reading (21', 25) and comparing (22, 23) the content (101, 101") of the magnetic data memory (10) and the second data memory (17).

Embodiment 25 the system according to embodiment 24, wherein the monitoring unit has means for outputting an alarm display (24", 24''') and/or an alarm message (24) and/or an alarm signal (24', 24"), which are used to indicate a deviation of the content of the magnetic data memory (10) from the content of the second data memory (17).

Embodiment 26 the system according to any one of embodiments 21 to 25, wherein the system comprises means for wireless data transmission between the device (1) and the monitoring unit (2).

Embodiment 27 the system according to embodiment 26, wherein said means for wireless data transmission comprise the RFID transponder (132, 131), which is part of the device (1), and furthermore comprise an RFID reader, which is part of the monitoring unit (2).

Embodiment 28 the system according to any one of embodiments 23 to 27, wherein the system has, in addition to the monitoring unit (2), a further such monitoring unit (2'), wherein the monitoring unit (2) is arranged at a first location and wherein the further monitoring unit (2') is either embodied as movable as a so-called "handheld" unit or is arranged in a stationary manner at a second location, to electronically seal the object (4) at the first location, transport it to the second location, and be able to check the electronic sealing at the second location.

Embodiment 29 a method for monitoring the manipulation of a transportable object (4) comprising the following steps:

a) ensuring a geometrical distance sufficiently large for data storage in a magnetic data memory (10) of the magnetic data memory (10) from a permanent magnet (11);
b) transmitting and writing an item of checking information (101) from a monitoring unit (2) into the magnetic data memory (10);
c) transmitting and writing the item of checking information (101) in a second data memory (17);
d) transporting the object (4) to a predefined intended location;
e) reading out, transmitting, and comparing the content of the magnetic data memory (10) to the content of the second data memory (17).

Embodiment 30 the method according to embodiment 29, wherein the method also has the following step between step c.) and step d.):

c2.) reading out, transmitting, and comparing the content of the magnetic data memory (10) to the content of the second data memory (17) to check the previously performed data transmission and writing procedures.

Embodiment 31 the method according to either one of embodiments 29 to 30, wherein method step d.) is supplemented by the following method step:

d2.) destroying the item of checking information (101) by reducing the distance between the permanent magnet (11) and the magnetic data memory (10) by using a mechanism (12).

Embodiment 32 the method according to any one of embodiments 29 to 31, characterized in that the method is supplemented by the following step after step e.):

f1.) If a difference is established in step e.) between the content of the magnetic data memory (10) and the content of the second data memory (17), an item of information is output which states that a manipulation is present.

Embodiment 33 the method according to any one of embodiments 29 to 32, characterized in that the method is supplemented by the following step after step e.):

f2.) If a correspondence is established in step e.) between the content of the magnetic data memory (10) and the content of the second data memory (17), an item of information is output which states that no manipulation is present.

Embodiment 34 the method according to any one of embodiments 29 to 33, wherein the transmission and writing of the items of checking information (101) in method step b.) take place in a password-protected manner.

Embodiment 35 the method according to any one of embodiments 29 to 34, wherein the readout and transmission of the content of the magnetic data memory (10) in method step e.) take place in a password-protected manner.

Embodiment 36 the method according to any one of embodiments 29 to 35, wherein the data transmission in method step b.) and/or in method step e.) take places in an encrypted manner.

Embodiment 37 the method according to any one of embodiments 29 to 36, wherein the method comprises a wireless transmission of data to write the magnetic data memory (10) and/or to read out the content of the magnetic data memory (10).

Embodiment 38 the method according to embodiment 37, characterized in that, for the wireless transmission of the data, an RFID reader communicates wirelessly with an RFID transponder (132, 131), wherein the RFID transponder (132, 131) transmits data to the magnetic data memory (10) and/or receives data therefrom via a data line (14).

LIST OF REFERENCE SIGNS

1 device for monitoring the manipulation
10 magnetic data memory
101 item of checking information
101, 101 random numbers
11 permanent magnet
12 actuator
121 handle of the actuator
122 slide rail of the actuator
123 actuating pin
13 data interface
131 RFID antenna
132 RFID chip
133,133' internal data line
134,134',134" data terminal
14,14' bidirectional data connection
15 housing
16 spring element
17 second data memory
18 expanded component
18' integrated component
2,2' monitoring unit, further monitoring unit
21,21 antenna
22 memory
23 operator
24,24',24",24" output unit, mobile wireless connection, loudspeaker, light, computer, . . .
25 processor
4 transportation box
41 flap
42 hinge
43 hinge side
46 tab
461 slot of the tab
48 eye
5 padlock-type device
50 mechanism
51 bracket
510 curved region of the bracket
511 locking region/toothed rack of the bracket
513 teeth of the toothed rack
53 locking element
531 counter teeth of the locking element
532 diagonal slot
M1, M2, M3, M4, M5 messages

The invention claimed is:

1. A device for monitoring the manipulation of a transportable object, wherein the device comprises the following base elements:

a first magnetic data memory for storing an item of checking information;

a permanent magnet for destroying the item of checking information, wherein the permanent magnet is spaced from the first magnetic data memory a distance such that the first magnetic data memory is unaffected by the permanent magnet;

a mechanism for carrying out a destruction of the item of checking information of the first magnetic data memory by moving the permanent magnet closer to the first magnetic data memory;

a data interface;

a data connection between the first magnetic data memory and the data interface for the bidirectional data exchange between the first magnetic data memory and the data interface;

a second magnetic data memory for separately storing the item of checking information, wherein the content of the first magnetic data memory can be separately destroyed by the permanent magnet and the content of the second magnetic data memory can be maintained unchanged simultaneously.

2. The device as claimed in claim 1, wherein the first magnetic data memory is embodied in MRAM ("magnetoresistive random access memory") technology.

3. The device as claimed in claim 1, wherein said mechanism comprises at least one part, on which the permanent magnet is arranged and/or which mechanically interacts indirectly or directly with the permanent magnet and therefore the mechanism is capable of reducing the distance between the permanent magnet and the first magnetic data memory, to thus destroy the item of checking information stored in the first magnetic data memory.

4. The device as claimed in claim 3, wherein said part is an actuator, and wherein the device furthermore has a housing, in which or on which the base elements of the device are arranged, wherein the actuator is held so that it is movable in and/or on the housing.

5. The device as claimed in claim 4, wherein the actuator protrudes at least partially out of the housing for actuation and/or is actuable through a window of the housing.

6. The device as claimed in claim 5, wherein the mechanism furthermore has a spring element, the spring force of which counteracts an actuation of the actuator.

7. The device as claimed in claim 4, wherein the mechanism furthermore has a locking element and a bracket, wherein the bracket has a curved region at a first end and a locking region at the other end, which is capable of interacting with the locking element for locking.

8. The device as claimed in claim 7, wherein the locking region of the bracket is formed by a toothed rack, which is distinguished in that it has teeth, which are spaced apart from one another by intermediate spaces, and in that the locking element has one or more counter teeth, which are capable of engaging in the intermediate spaces of the teeth of the toothed rack for locking.

9. The device as claimed in claim 8, wherein the actuator and the locking element are either jointly embodied in one piece, or mechanically locking and/or unlocking.

10. The device as claimed in claim 1, wherein the first and the second magnetic data memory each have a password protection.

11. The device as claimed in claim 1, wherein the device comprises an RFID transponder or at least one RFID chip and an associated antenna.

12. A system, comprising a device as claimed in claim 1, and furthermore comprising the transportable object to be monitored, wherein the transportable object has a manipulation-significant part.

13. The system as claimed in claim 12, wherein the object to be monitored is a transportation container and the manipulation-significant part is a closure, a cover, a door, a flap, or a lock, for opening the transportation container to be monitored for manipulation.

14. The system as claimed in claim 12, wherein the system furthermore comprises a separate monitoring unit, which has a reader and comparator for reading and comparing the content of the first magnetic data memory and the second magnetic data memory and furthermore has an outputter for outputting an alarm display and/or an alarm message and/or an alarm signal, which are used to indicate a deviation of the content of the first magnetic data memory from the content of the second data memory.

15. The system as claimed in claim 14, wherein the reader comprises an RFID reader.

16. A method for monitoring the manipulation of a transportable object comprising the following steps:

a) providing a device including a first magnetic data memory, a permanent magnet, a mechanism for moving the permanent magnet, and a second magnetic data memory, as claimed in claim 1;

b) transmitting and writing an item of checking information from a monitoring unit into the first magnetic data memory;

c) transmitting and writing the item of checking information in the second magnetic data memory;

d) transporting the object to a predefined intended location;

e) destroying the item of control information by reducing the distance between the permanent magnet and the first magnetic data memory by using the mechanism;

f) reading out, transmitting, and comparing the content of the first magnetic data memory to the content of the second magnetic data memory; and g) if a difference is established in step f) between the content of the first magnetic data memory and the content of the second magnetic data memory, an item of information is output which states that a manipulation exists.

17. The method as claimed in claim 16, wherein the method is supplemented after step f) by the following step:

if a correspondence is established in step f) of the content of the first magnetic data memory to the content of the second magnetic data memory, an item of information is output which states that no manipulation exists.

18. The method as claimed in claim 16, wherein the item of checking information and/or in the second magnetic data memory takes place in an encrypted and/or password-protected manner.

19. The method as claimed in claim 16, wherein the data transmission and read procedures in method steps b), c) and f) take place wirelessly.

20. The method as claimed in claim 19, wherein for the wireless transmission of the data, an RFID reader communicates wirelessly with an RFID transponder, wherein the RFID transponder transmits data to the first magnetic data memory and/or receives it therefrom via a data line.

21. An integrated component for carrying out a method as claimed in claim 16, wherein the component comprises the following:

the first magnetic data memory for storing the item of checking information;

the second magnetic data memory for retaining the item of checking information;

a data interface for transmitting the item of checking information.

22. The integrated component as claimed in claim 21, wherein the data interface is embodied as an RFID chip.

23. The integrated component as claimed in claim 21, wherein the first magnetic data memory is embodied in MRAM ("magnetoresistive random access memory") technology.

24. The integrated component as claimed in claim 21, wherein the second magnetic data memory is an EPROM, an EEPROM, a flash memory, an F-RAM, or an S-RAM.

25. The integrated component as claimed in claim 21, wherein the integrated component additionally has a microprocessor.

26. The integrated component as claimed in claim 21, wherein the integrated component is embodied as an integrated circuit.

* * * * *